United States Patent [19]

Sawada et al.

[11] Patent Number: 4,559,290

[45] Date of Patent: Dec. 17, 1985

[54] HEAT DEVELOPMENT WITH REDUCIBLE DYE RELEASER

[75] Inventors: Satoru Sawada; Shinsaku Fujita; Koichi Koyama, all of Kanagawa, Japan

[73] Assignee: Fuji Photo Film Co., Ltd., Kanagawa, Japan

[21] Appl. No.: 582,655

[22] Filed: Feb. 23, 1984

[30] Foreign Application Priority Data

Feb. 23, 1983 [JP] Japan ..... 58-28928

[51] Int. Cl.[4] ..... G03C 1/40; G03C 5/54

[52] U.S. Cl. ..... 430/203; 430/223; 430/351; 430/559

[58] Field of Search ..... 430/203, 223, 617, 619, 430/559, 351, 353

[56] References Cited

U.S. PATENT DOCUMENTS 4,139,379 2/1979 Chasman et al. ..... 430/223

4,232,107 11/1980 Janssens ..... 430/223

4,430,415 2/1984 Aono et al. ..... 430/351

4,450,223 5/1958 Van Poucke et al. ..... 430/223

OTHER PUBLICATIONS

"Method of Forming . . . Dye Image", Holstead et al., *Research Disclosure,* No. 16966, 5/1978, pp. 54–58.

*Primary Examiner*—Richard L. Schilling

*Attorney, Agent, or Firm*—Sughrue, Mion, Zinn, Macpeak, and Seas

[57] ABSTRACT

An image-forming method comprising heating a light-sensitive material in a substantially water-free condition is described. The method uses a light-sensitive material comprised of a support having thereon at least light-sensitive silver halide, a binder, an electron donor and/or electron-transfer agent capable of reducing light-sensitive silver halide, and an immobile dye-releasing substance releasing a mobile dye upon reduction with the electron donor and/or electron-transfer agent.

21 Claims, No Drawings

HEAT DEVELOPMENT WITH REDUCIBLE DYE RELEASER

FIELD OF THE INVENTION

The present invention relates to a novel method of forming positive dye images by heating in a substantially water-free condition.

The present invention further relates to a novel light-sensitive material containing an immobile dye-providing substance which releases a hydrophilic dye on reacting with a portion of an electron transfer agent and/or electron donor remaining after the reaction between the electron transfer agent and/or electron donor and an organic silver salt oxidizing agent and/or light-sensitive silver halide occurring when the light-sensitive material is heated in a substantially water-free condition, that is, which does not originally release a hydrophilic dye, but releases the hydrophilic dye through reduction thereof.

The invention further relates to a novel light-sensitive photographic material containing an immobile dye-providing material which releases a dye by heating but becomes a material not releasing a dye by causing a reaction with photosensitive silver halide and/or an organic silver salt oxidizing agent by heating, that is, becomes a material not releasing a hydrophilic dye when the immobile dye-providing material is oxidized at a portion where a silver image is formed.

Furthermore, the invention relates to a novel process of obtaining a dye image by transferring a dye released by heating into a dye-fixing layer.

BACKGROUND OF THE INVENTION

Since a photographic process using silver halide is excellent in photographic properties such as sensitivity and gradation control as compared to other photographic processes such as electrophotography and diazo photographic process, the silver halide photographic process has hitherto been most widely used. Recently, a technique capable of more easily and rapidly obtaining images has been developed by changing an image-forming process of a silver halide photographic material from a conventional wet process such as a process which uses a liquid developer to a dry process such as a developing process which uses heating.

Heat developable photographic materials are known in this art and the heat developable materials and image-forming processes using these heat developable materials are described in, for example, "Shashin Kogaku no Kiso (The Basis of Photographic Engineering)", pages 553–555, published by Corona K. K. in 1979; "Eizo Jooho (Image Information)", page 40, published in April, 1978; "Nebletts Handbook of Photography and Reprography", 7th Ed., pages 32–33, (Van Nostrand Reinhold Company); U.S. Pat. Nos. 3,152,904, 3,301,678, 3,392,020, 3,457,075; U.K. Patent Nos. 1,131,108 and 1,167,7;77; and "Research Disclosure" (RD-17029), pages 9–15, June 1978.

Various processes have been proposed for obtaining dye images by a dry system. For example, for forming color images by a combination of the oxidation product of a developing agent and a coupler, there are proposed a combination of a p-phenylenediamine reducing agent and a phenolic or active methylene coupler in U.S. Pat. No. 3,531,286; p-aminophenol series reducing agents in U.S. Pat. No. 3,761,270; p-aminophenol series reducing agents in Belgian Patent No. 802,519 and a sulphonamidophenol series in "Research Disclosure", pages 31–32, September 1975; and a combination of a sulfonamidophenol series reducing agent and a 4-equivalent coupler in U.S. Pat. No. 4,021,240.

However, in these processes there is a fault that color images become turbid since images of reducing silver and color images are simultaneously formed at light exposed areas after heat development. For overcoming the fault, there are proposed a process of removing the silver images by liquid processing and a process of transferring the dyes only to another layer, for example, a sheet having an image-receiving layer. However, there remains a fault that it is not easy to discriminate a dye from the reaction mixture and transfer the dye by itself.

Also, a process of introducing a nitrogen-containing heterocyclic ring group into a dye, forming a silver salt, and liberating the dye by heat development is described in "Research Disclosure", pages 54–58, May 1978. However, in the process it is difficult to control the liberation of the dye at non-exposed areas, whereby a clear image cannot be obtained and hence the foregoing process is unsuitable for general use.

Furthermore, a process of forming color images by utilizing leuco dyes is described in, for example, U.S. Pat. Nos. 3,985,565 and 4,022,617. However, in the process it is difficult to stably incorporate leuco dyes in photographic materials, that is, the photographic materials containing leuco dyes are gradually colored when they are preserved.

Also, for forming a positive color image by a heat sensitive silver dye bleaching process, there are described useful dye bleaching processes in "Research Disclosure", pages 30–32, April 1976; ibid., pages 14–15, December 1976; U.S. Pat. No. 4,235,957, etc.

However, these processes have such faults that additional steps and material are required for accelerating the bleaching of dye, for example, it is required to superpose an activating agent sheet on the light-sensitive material and heat the assembly, and also color images obtained are gradually bleached by reduction with free silver, etc., existing in the light-sensitive material during the preservation of the images for a long period of time.

SUMMARY OF THE INVENTION

An object of this invention is to overcome the foregoing difficulties in the conventional light-sensitive photographic materials and to provide a novel process for forming dye images negative to silver images by heating a photosensitive material.

Another object of this invention is to provide a novel image-forming process for obtaining a dye image by transferring a mobile dye released by heating into a dye-fixing layer.

Another object of the invention is to provide a novel light-sensitive material containing dye-providing substances which when heated in a substantially water-free condition, react with light-sensitive silver halide and/or organosilver salt oxidizing agents to release mobile dyes.

Another object of the invention is to provide a method of forming sharp dye images in a simplified manner.

It has been found that the above objects are attained by using a combination of light-sensitive silver halide, a binder, an electron donor and/or electron-transferring agent capable of reducing light-sensitive silver halide, and an immobile dye-providing substance releasing a mobile dye on reduction with the electron donor and/or electron-transferring agent (this substance is hereinafter referred to merely as a "reducible dye-releasing agent").

The present invention relates to an image-forming method which comprises heating a light-sensitive material in a substantially water-free condition after imagewise exposure or simultaneously with imagewise exposure wherein said light-sensitive material includes at least light-sensitive silver halide, a binder, an electron donor and/or electron-transferring agent capable of reducing light-sensitive silver halide, and an immobile dye-releasing substance releasing a mobile dye on reduction with the electron donor and/or electron-transferring agent on its support.

The present invention further relates to a heat development type color light-sensitive material which includes at least a light-sensitive silver halide, a binder, an electron donor and/or electron-transferring agent capable of reducing light-sensitive silver halide, and an immobile dye-providing substance which is reduced by the electron donor and/or electron-transferring agent, releasing a mobile dye, on its support.

DETAILED DESCRIPTION OF THE INVENTION

The term "dye image" is used herein to refer to both panchromatic and monochromatic dye images. This monochromatic dye image includes a monochromatic image resulting from admixture of two or more dyes.

In accordance with the image-forming method of the invention, a mobile dye is formed in an area corresponding to undeveloped silver halide simultaneously with the formation of a silver image. That is, when a light-sensitive material containing a immobile dye-providing substance which originally does not release a hydrophilic dye, but when reduced, releases a hydrophilic dye is exposed imagewise to light and heat-developed, an oxidation-reduction reaction occurs between (an organosilver salt oxidizing agent and/or) light-sensitive silver halide and a reducing electron-transferring agent and/or electron donor with the above-exposed light-sensitive silver halide as a catalyst. This results in the formation of a silver image in the exposed area and the oxidation of the electron-transferring agent and/or electron donor. On the other hand, in the unexposed area, the reducible dye-releasing agent is reduced by the electron-transferring agent and/or electron donor remaining as an inverse function of the silver image formed in the exposed area, releasing a hydrophilic mobile dye and thus resulting in the formation of a mobile dye image in the unexposed area.

An example of the reducible dye-releasing agent as used herein is a ballasted compound which releases a mobile dye by intramolecular nucleophilic displacement. This ballasted compound includes a precursor of a nucleophilic group which must receive therein at least one electron before it undergoes an intramolecular nucleophilic displacement reaction.

The ballasted compound becomes useful in the present invention when it is used in combination with the electron donor (i.e., a reducing agent providing an electron for reducing the ballasted compound into the state in which it can undergo the intramolecular nucleophilic displacement reaction). The ballasted compound, which undergoes an intramolecular nucleophilic displacement reaction upon receipt of an electron, is given electrons in a pattern corresponding to the image and subsequently undergoes the intramolecular nucleophilic displacement reaction, releasing the dye in the same pattern as above.

The first compound, i.e., ballasted compound, of the reducible dye-releasing agent of the invention which has been found especially useful for the heat development type color photographic processing method and photographic element can be represented by the following schematic formula:

$$\left(\begin{matrix}\text{Ballasted}\\ \text{carrier}\end{matrix}\right)_x-\left(\begin{matrix}\text{Electrophilic}\\ \text{leaving group}\end{matrix}\right)_y-\left(\begin{matrix}\text{Mobile dye}\\ \text{component}\end{matrix}\right)_z$$

(wherein x, y and z are each a positive integer and preferably 1 or 2).

The compounds represented by the above formula include a compound in which at least two mobile dye components are linked to one ballast group, and a compound in which at least two ballasts are linked to one mobile dye component. The ballasted carrier is a group capable of immobilizing the above-described compound under heat diffusion transfer conditions. This ballasted carrier includes a group which provides a nucleophilic group (a group capable of causing intramolecular nucleophilic displacement in combination with the above-described electrophilic cleavage group) upon receipt of at least one electron.

The ballasted compound represented by the above formula contains an electrophilic leaving group which links the ballasted carrier to the corresponding mobile dye component.

The nucleophilic group formed by reduction reacts with the electrophilic leaving group.

When the electrophilic leaving group reacts, part of the group remains along with the ballasted carrier, and part of the group remains along with the mobile dye component.

The term "nucleophilic displacement" is understood to refer to a reaction in which a nucleophilic center on a certain molecule attacks another site (i.e., an electrophilic center) of the same molecule, causing the displacement of a group or atom linked at the electrophilic center. The term "nucleophilic displacement" refers not to rearrangement of part of a molecule on the molecule, but to a mechanism in which displacement occurs actually. That is, the electrophilic center should be capable of forming a ring structure in combination with the nucleophilic group.

In general, an intramolecular nucleophilic displacement compound is a compound containing nucleophilic and electrophilic groups which are present in a close relation to each other in the three-dimensional structure of the molecule and thus are capable of undergoing an intramolecular reaction. Compounds containing the electrophilic and nucleophilic groups at positions where they can react with each other can be used, including polymeric compounds, macrocyclic compounds, polycyclic compounds, and enzyme ring-structure compounds. Preferred are compounds containing the nucleophilic and electrophilic groups at such positions that a cyclic organic ring or temporary organic ring is easily formed by the intramolecular reaction of the nucleophilic group at the electrophilic center.

Preferably the nucleophilic and electrophilic groups are positioned in compounds capable of forming a 3- or 5- to 7-membered ring (preferably, a 5- or 6-membered ring). It is known that a 4-membered ring is generally difficult to form by an organic reaction. In the compounds of the invention, the intramolecular nucleophilic displacement occurs after the nucleophilic precursor receives at least one electron.

Thus, the compound used in this invention is stable under the conditions of processing except where the primary release of a compound occurs as a direct function of the reduction of a nucleophilic precursor group.

The compound of the invention contains a nucleophilic precursor group and an electrophilic cleavage group which are bonded to each other through a bonding group. This bonding group may be an acyclic one, but preferably is a cyclic one. The reason is that the cyclic bonding group produces an arrangement which is advantageous for the attack of the intramolecular nucleophilic group onto the electrophilic center. In a very preferred embodiment, both the nucleophilic precursor group and the electrophilic group are linked to the same aromatic ring structure. This ring structure may be either a carbocyclic one or a heterocyclic one, and includes a fused ring in which the groups can be positioned at different rings. Preferably both the groups are linked directly to the same aromatic ring (preferably carboxyclic one).

In a preferred embodiment, the first compound of the reducible dye-releasing agent of the invention, i.e., the ballasted compound, contains from 1 to about 5 atoms, preferably 3 or 4 atoms, between the nucleophilic center of the nucleophilic group and the atom constituting the electrophilic center. Thus the nucleophilic center can form a from 3 to 7-membered ring and preferably a 5- or 6-membered ring in combination with the center of the electrophilic group.

The first compound as described above is represented by the following general formula (I):

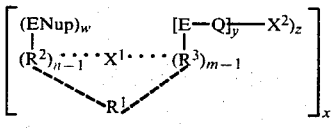

(I)

wherein w, x, y, z, n and m are each 1 or 2;

ENup is an electron-receiving nucleophilic group precursor, such as a hydroxyamino group precursor (e.g., a nitroso group (NO) and a stable nitroxyl free radical (N—O·), and preferably a nitro group ($NO_2$)), or a hydroxyl group precursor (preferably an oxo group (=O)), and may be an imine group (which is hydrolyzed into an oxo group before it receives an electron in an alkaline environment);

$R^1$ is an acyclic organic group or preferably a cyclic organic group (including a bridged ring group), may be a polycyclic group (preferably having from 5 to 7 atoms in the ring to which ENup and E are bonded), is preferably a 5- or 6-membered aromatic ring, or a carboxyclic group, such as a benzenoid group, or a heterocyclic ring (in which ENuP constitutes part of the ring, i.e., ENup is a nitroxyl group containing a nitrogen atom in the ring), which includes a non-aromatic ring, and contains not more than 50 atoms and preferably not more than 15 atoms;

$R^2$ and $R^3$ are each a divalent organic group containing from 1 to 3 atoms in a divalent bonding group, may be an alkylene group and further oxaalkylene, thiaalkylene, azaalkylene and alkyl or aryl-substituted nitrogen, contains a large group at the side chain of the above-described bonding group, which can act as a ballast, contains at least 8 carbon atoms, is $X^1$ when $X^1$ is a ballast group, and $R^3$ is preferably a dialkyl-substituted methylene bond, for example, dimethylalkylene which is especially useful when Q is an oxygen atom and $R^1$ and ENup form a quinone;

E and Q provide an electrophilic cleavage group;

E is an electrophilic center and preferably a carbonyl group (which includes carbonyl (—CO—) and thiocarbonyl (—CS—)) and may be a sulfonyl group;

Q is a group providing a monoatomic bond between E and $X^2$: the monoatom is a nonmetal atom of Groups $V_A$ and $VI_A$ of the Periodic Table and having a valency of −2 or −3, for example, an oxygen atom, a sulfur atom or a selenium atom, and preferably a nitrogen atom providing an amino group: the above-described atom provides a covalent bond which connects $X^2$ to E, and when it is a trivalent atom, it can be mono-substituted by a hydrogen atom, an alkyl group containing from 1 to 20 carbon atoms, preferably from 1 to 10 carbon atoms (which includes a substituted carbon atom and a carbocyclic group), or an aryl group containing from 6 to 20 carbon atoms (which includes a substituted aryl group) at an atom which is necessary for forming a from 5- to 7-membered ring (e.g., a pyridine group or a piperidine group) in combination with $X^2$;

$X^1$ is a substituent on at least one of $R^1$, $R^2$ and $R^3$: one of $X^1$ and Q—$X^2$ represents at least one ballast group having a large size sufficient to immobilize the above-described compound in the layer of the photographic element, and one of $X^1$ and Q—$X^2$ is a photographically useful dye (or its precursor) and contains a bonding group necessary for bonding each component to E or $R^1$;

$R^1$, $R^2$ and $R^3$ are chosen so as to be in a close relation to E of ENup: the reason is that the intramolecular nucleophilic release of Q from E can be attained, and preferably are chosen so as to provide one atom or from 3 to 5 atoms between the atom constituting the nucleophilic center of the nucleophilic group and the atom constituting the electrophilic center so that the above-described compound can form a 3- or from 5- to 7-membered ring, most preferably a 5- or 6-membered ring in the intramolecular nucleophilic displacement of the Q—$X^2$ from the above-described electrophilic group. In a certain embodiment, i.e., when Q is an amino group, preferably an alkyl or aryl-substituted amino group, $X^2$ is bonded to Q through a sulfonyl group, and the sulfonyl group is provided by the release of Q—$X^2$.

In the compound of the general formula (I), the stability and releasing rate of the electrophilic cleavage group can be varied by using a specific atom or group contained in the bonding group adjacent to the group (E—Q). In some cases, it is desired to contain an amino group in $R^3$ just adjacent to E, particularly when E is a carbonyl group and ENup is an oxo group. In a certain embodiment, it is desired to contain a specific group at a position just adjacent to Q of the bonding group; that is, ⟵Q—$X^2$) becomes a group ⟵Q—$R^9$—$X^3$⟶, wherein $R^9$ is a group like an aromatic group as defined herein.

When, however, $X^1$ is a photographically useful dye radical, the group should be bonded in such a manner that the activity of the photographically useful group is not dependent on the release of the group.

The properties of the ballast group contained in the above-described compound is not subject to special limitations as long as a ballast-side portion of E mainly acts to provide immobilization. The other portion of E contains a sufficiently solubilization group which makes it movable and further diffusible in an alkaline medium after the release thereof. Therefore, if $R^1$, $R^2$ and $R^3$ provide the compound with sufficient insolubility so that it becomes immobile, $X^1$ may be a relatively small group. However, if $X^1$ or $\leftarrow$Q—$X^2$) functions as a ballast, they are generally composed of a long-chain alkyl group, and benzene and naphthalene-based aromatic groups. A typical useful ballast-functioning group contains at least 8 carbon atoms and preferably at least 14 carbon atoms. If $X^1$ is a ballast, it can be at least one group which is substituted by $R^1$, $R^2$ or $R^3$ and which provides the desired immobility. Therefore, two small groups, for example, two groups containing from 5 to 12 carbon atoms can be used in place of a long ballast group containing from 8 to 20 carbon atoms with the same immobility. When a number of ballast groups are used, it is sometimes convenient for the ballast to contain an electron-withdrawing bond between the major portion of the ballast group and the aromatic ring bonded thereto, particularly when the electron-receiving nucleophilic precursor is a nitro substituent for the above-described ring.

The term "nucleophilic group" as used herein means an atom or atomic group containing an electron pair capable of forming a covalent bond. This type of group is often an ionizable group which reacts as an anion group. The term "electron-receiving nucleophilic precursor" means a precursor group which provides a nucleophilic group upon receipt of at least one electron, i.e., by a reduction reaction. The electron-receiving nucleophilic precursor group is lower in nucleophilic properties than the reduced group, or has the structure that exerts adverse influences on the close relation between the electrophilic center and the nucleophilic center.

The nucleophilic group contains one nucleophilic group, such as an oxygen atom, in the hydroxyl group. The nucleophilic group can contain at least one atom capable of being a nucleophilic center as in the case of a hydroxylamino group in which either a nitrogen atom or an oxygen atom can become a nucleophilic center. When the nucleophilic group of the intramolecular nucleophilic displacement compound of the invention contains more than 1 nucleophilic center, a nucleophilic attack and displacement may generally occur at a center where the most favorable ring structure can be formed. That is, if it is assumed that the oxygen atom of a hydroxylamino group often forms a 7-membered ring and the nitrogen atom often forms a 6-membered ring, it can be said that the active nucleophilic center is generally the nitrogen atom.

The term "electrophilic group" as used herein means an atom or atomic group which can receive an electron pair for the formation of covalent bond. Typical examples of such electrophilic groups are sulfonyl (—$SO_2$—), carbonyl (—CO—), and thicarbonyl (—CS—). The carbon atom of the carbonyl group or the sulfur atom of the sulfonyl group can form an electrophilic center for the group and receive partially a positive charge. The term "electrophilic cleavage group" is used herein to refer to the group of (—E—Q—). In this group, E represents an electrophilic group, and Q represents a leaving group providing a monoatomic bond between E and $X^2$. This monoatom is a non-metal atom having a valency of 2 or 3. This leaving group can receive a pair of electrons released from the electrophilic group. When the non-metal atom is a trivalent one, it may be substituted by one substituent. This substituent includes a hydrogen atom, an alkyl group (including a substituted alkyl group and a cycloalkyl group), an aryl group (including a substituted aryl group), and an atomic group necessary for forming in combination with $X^2$ a 5- to 7-membered ring, such as a pyridine or piperadine group. In an embodiment, a methylene group (—$CH_2$—) can be used as an electrophilic group when m is 2 in the above-described formula. In this case, $R^3$ is an alkylene group, such as diethylmethylene, or diarylmethylene bond containing a di-substituted methylene bond, which is bonded directly to an aromatic group given by $R^1$. In this embodiment, $X^2$ can contain a carbonyl group, a sulfonyl group or a phosphono group which is bonded to the leaving group. When it is released, the carboxyl group, sulfonato group or phosphonato group results. The presence of the di-substituted methylene group contained in the bond between the nucleophilic and electrophilic cleavage groups clearly provides an orientation which is more advantageous for the group released. This increases the rate of intramolecular nucleophilic displacement when a methylene group is used as the electrophilic group.

The compound of the invention can contain a substituent which changes the rate of reaction thereof. In a very preferred embodiment, the substituent is positioned at the cyclic aromatic group represented by $R^1$ and improves the rate of reaction when the compound is used in an image transfer film unit. In a preferred embodiment, particularly when ENup is a nitro group, the aromatic ring to which ENup and $X^1$ are linked contains at least one, preferably 2 electron-withdrawing groups thereon. An example of such electron-withdrawing group is a sulfonyl group having a positive Hammett's $\sigma$ value.

If the electron-withdrawing substituent is positioned at $R^1$, the compound of the invention is generally reduced more easily. Thus, a wider variety of electron donors can be used in combination with the compound of the invention. However, in the case of the other compounds of the invention, stronger electron donors are necessary to use in order to obtain a rapid reduction rate therefor. When the nucleophilic precursor group is a nitro group, at least two electron-recovering groups are attached to the aromatic ring in combination with the preferred benzoisooxazolone electron donor in order to obtain the desired reduction rate.

The term "non-diffusing" is used herein in the usual sense as used in the art of photography. The term "immobile" is also used in the usual sense. On the other hand, the term "diffusing" acquires the opposite meaning when it is applied to the compound of the invention. The term "mobile" is used herein in the usual sense.

Typical examples of the useful reducible dye-releasing compounds of the invention are the ballasted compounds represented by the following general formula (IA).

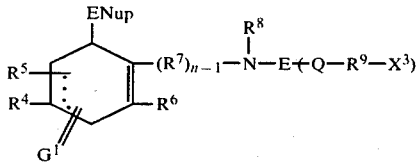

(IA)

wherein:

ENup is an electron-receiving nucleophilic precursor (including an imino group and an oxo group, said oxy group being preferred) for a hydroxy nucleophilic group;

$G^1$ is an imino group (including an alkylimino group), a sulfonimido group, a cyclic group formed in combination with $R^4$ or $R^6$, or a group specified by ENup, and preferably is located at a para-position relative to ENup;

E is an electrophilic group and may be either carbonyl (—CO—) or thiocarbonyl (—CS—), said carbonyl being preferred;

$Q_1$ is a group forming a monoatomic bond between E and $R^9$: the monoatom is a non-metal of Group $V_A$ or $VI_A$ of the Periodic Table and having a valency of −2 or −3, for example, a nitrogen atom, an oxygen atom, a sulfur atom or a selenium atom, and forms two covalent bonds for bonding E to $R^9$, and when Q is a trivalent atom, it is a hydrogen atom, an alkyl group containing from 1 to 10 carbon atoms, an aromatic group containing from 5 to 20 carbon atoms (e.g., an aryl group and a substituted aryl group), or an atomic group necessary for forming a from 5- to 7-membered ring in combination with $R^9$;

$R^7$ is an alkylene group (including a substituted alkylene group) containing from 1 to 3 carbon atoms in the bonding group, or an alkylene group in which at least one methylene contained in the bonding group is a dialkyl or diarylmethylene bonding group, and preferably an alkylene group containing one carbon atom in the divalent bonding group, for example, a methylene bonding group or dialkyl- or diaryl-substituted methylene bonding group;

n is an integer of 1 or 2;

$R^9$ may be an aromatic group containing at least 5 carbon atoms, preferably from 5 to 20 carbon atoms, which includes a heterocyclic group, such as groups containing a nucleus (e.g., pyridine, tetrazole, benzimidazole, benzotriazole, and isoquinoline), or a carbocyclic arylene group containing from 6 to 20 carbon atoms (preferably a phenylene group or a phenylene group, or a substituted phenylene or naphthylene group), and may be an aliphatic hydrocarbon group, such as an alkylene group containing from 1 to 12 carbon atoms, which includes a substituted alkylene group;

$R^8$ may be an alkyl group containing from 1 to 40 carbon atoms (including a substituted alkyl group and a cycloalkyl group), and an aryl group containing from 6 to 40 carbon atoms (including a substituted aryl group), and further may be a substituent $X^1$ as defined above;

$R^6$, $R^4$ and $R^5$ may each be a one-atom substituent, such as a hydrogen atom and a halogen atom, and preferably is a polyatomic substituent, such as an alkyl group containing from 1 to 40 carbon atoms (including a substituted alkyl group and a cycloalkyl group), an alkoxy group, an aryl group containing from 6 to 40 carbon atoms (including a substituted aryl group), a carbonyl group, a sulfomyl group, and a sulfonamido group, or they may each be the substituent $X^1$ assuming that $R^6$ and $R^5$ or $R^4$ and $R^5$ can combine together and form a 5- to 7-membered ring in combination with the remaining portion of the molecule containing a bridged ring.

When $R^9$ is an aliphatic hydrocarbon group such as an alkylene group, $R^6$ and $R^4$ should be polyatomic substituents and preferably $R^5$ is a polyatomic substituent. When $G^1$ is an electron-receiving nucleophilic precursor as defined for ENup, the $R^4$ or $R^6$ substituent adjacent to $G^1$ is a group having the following equation:

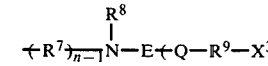

It is assumed that $G^1$ is a compound having a number of groups capable of being released by nucleophilic displacement. $X^1$ and $\text{-}(Q\text{—}R^9\text{—}X^3)$ may be each a ballasting group having a sufficiently large size for immobilization in the binder layer of the photographic element, or one of $X^1$ and $\text{-}(Q\text{—}R^9\text{—}X^3)$ is a ballast group and the other may be a photographically useful group, such as a photographic reagent, or preferably a photographically useful group assuming that it is a dye-providing substance, such as image dye, or an image dye precursor. $R^7$ is chosen so as to be substantially close to E of the nucleophilic group, and permits the intramolecular nucleophilic reaction accompanied by the release of Q from E. Preferably it is chosen so as to provide from 3 to 5 atoms between the atom, nucleophilic center of the above-described nucleophilic group and the atom, electrophilic center of the above-described electrophilic group. Thus the compound of the invention can form a 5- to 8-membered ring, most preferably a 5- or 6-membered ring, by the intramolecular nucleophilic displacement of the group $\text{—}Q\text{—}R^9\text{—}X^3)$ from the above-described electrophilic group. Typical examples of useful compounds of the above-described type are Compound IA-1 to IA-9 as described hereinafter. In a certain representative example, the compound of the general formula as described above, when $R^3$ is a bulky substituent and brings about steric hindrance, exhibits superior image-forming properties such as improved Dmin and increased stability after processing. Typical useful bulky groups which can be used as $R^8$ are cyclohexyl, isopropyl, isobutyl, and benzyl. When $R^4$, $R^5$ and $R^6$ contain bulky substituents providing steric hindrance to the adjacent portion to the quinone ring, image-forming characteristics can be improved. Typical substituents include an α- or β-substituted alkyl group such as α-methylalkylcyclohexyl, isopropyl, α-methylbenzyl, and p-tert-butyl-α-phenetyl. Although this bulky substituent is considered advantageous to be located in the compound of the above-described type, it can be used in such a manner that it is located at a similar position, whereby more improved photographic characteristics can be obtained. The compound represented by the formula (IA) can be synthesized by, for example, the method described in Japanese Patent Application (OPI) No. 110827/78 (the term "OPI" as used herein means a "published unexamined patent application").

A preferred example of the compound of the invention is a compound represented by the following formula (IB):

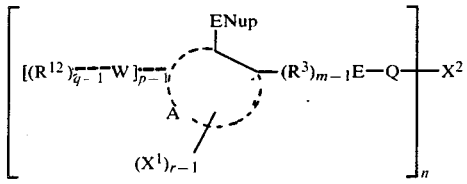

(IB)

wherein:

ENup is an electron-receiving precursor of a hydroxylamino group, such as nitroso (NO) and a stable nitroxyl group, with a nitro group ($NO_2$) being preferred;

A is a group containing an atomic group necessary for forming a 5- or 6-membered aromatic ring in combination with the remainder of the above-described formula, which includes a polycyclic aromatic ring structure: the aromatic ring may be a carbon ring or a heterocyclic ring, such as a group containing an aromatic onium group in the ring, and A is preferably a group necessary for forming a carbocyclic system such as a benzene ring or a naphthelene ring;

W is an electron-withdrawing group having a positive Hammett's $\sigma$ value, including groups or esters such as cyano, nitro, fluoro, chloro, bromo, iodo, trifluoromethyl, trialkylammonium, carbonyl, N-substituted carbamoyl, sulfoxide, sulfonyl and N-substituted sulfamoyl;

$R^{12}$ is a hydrogen atom, a substituted or unsubstituted alkyl group containing 1 to 30 carbon atoms, or a substituted or unsubstituted aryl group containing 6 to 30 carbon atoms;

$R^3$ is a divalent organic group containing from 1 to 3 carbon atoms in the divalent bonding group, which may be an alkylene group, an oxaalkylene group, a thiaalkylene group, an azaalkylene group, and an alkyl or aryl-substituted nitrogen, and preferably an alkylene bonding group containing at least one dialkyl or diaryl-substituted methylene in the bonding group;

m and q are each a positive integer of 1 or 2;

p and r are each a positive integer of 1 or more and p is preferably 3 or 4;

$[(R^{12})_{q-1}W]$ is a substituent at an arbitrary point of the aromatic ring structure of A;

E and Q provide an electrophilic cleavage group; E is an electrophilic center, preferably a carbonyl group including carbonyl (—CO—) and thiocarbonyl (—CS—), and may be a sulfonyl group, and Q is a group providing a monoatomic bond between E and $X^2$, and preferably an alkyl substituent-containing amino group, said alkyl substituent containing 1 to 20, preferably 1 to 10 carbon atoms, which includes an atomic group necessary for forming a from 5- to 7-membered ring in combination with a substituted alkyl group or Q—$X^2$, such as a pyridine group and a piperidine group;

n is an integer of from 1 to 3 and preferably 1;

$X^2$ is an image-providing substance, such as an image dye, or an image dye precursor as in the case of Q;

$X^1$ is a ballast-donating group as defined above, preferably a substituted or unsubstituted alkyl group containing from 8 to 30 carbon atoms and a substituted or unsubstituted aryl group containing from 8 to 30 carbon atoms (which includes a bonding group necessary for bonding to an aromatic ring), provided that at least one of $X^1$ and $R^{12}$ is a group having a large size sufficient to make the compound of the formula (IB) immobile and non-diffusible in an alkali transmitting layer of the photographic element; that is, preferably at least one of $X^1$ and $R^{12}$ contains from 12 to 30 carbon atoms.

It is to be noted that when a number of groups are present in the compound as represented by the above-described formula, they may be the same or different. That is, p is 3, and each ($R^{12}$+W) can be chosen from various specified substituents.

The electron-withdrawing group referred to in the definition of the above-described compound is one having a positive Hammett's $\sigma$ value, preferably a positive Hammett's value of not less than 0.2, or a group having a combined effect of more than 0.5 as a substituent for the aromatic ring. The Hammett's $\sigma$ value is determined by the method as described in *Steric Effects in Organic Chemistry,* John Wiley and Sons, Inc. (1956), pp. 570–574 and *Progress in Physical Organic Chemistry,* Vol. 2, Interscience Publishers (1964), pp. 333–339.

Useful electron-withdrawing groups having a positive Hammett's $\sigma$ value include cyano, nitro, fluoro, bromo, iodo, trifluoromethyl, trialkylammonium, carbonyl, N-substituted carbamoyl, sulfoxide, sulfonyl, N-substitued sulfamoyl and ester. The term "aromatic ring having an electron-withdrawing substituent" is used herein to refer to an onium compound in the ring and also to a group which is linked directly to the ring and can become a bonding group for other groups such as a ballast group.

The electron-withdrawing group contains in its ring the same groups as defined for the compound of the following formula:

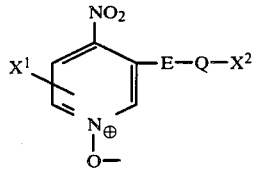

wherein E, Q, $X^1$ and $X^2$ are as defined above.

The compound of the formula (IB) can be prepared by the method described in Japanese Patent Application (OPI) No. 110827/78.

Other examples of the reducible dye-releasing agents of the invention are represented by the following general formula (IIA) or (IIB):

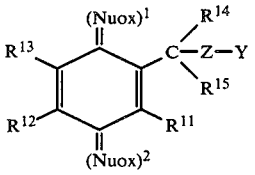

(IIA)

-continued

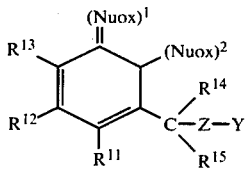

(IIB)

wherein:

(Nuox)$^1$ and (Nuox)$^2$ may be the same or different and each represents an oxidized nucleophilic group, such as O= and HN=;

Z represents a divalent atom group (e.g., a sulfonyl group) which is electrically negative relative to the carbon atom bearing $R^{14}$ and $R^{15}$;

Y represents a group which becomes a mobile dye after being released along with Z;

$R^{11}$, $R^{12}$ and $R^{13}$ are each a hydrogen atom, halogen, an alkyl group, an alkoxyl group or an acylamino group: $R^{11}$ and $R^{12}$ may form a condensed ring in combination with the remainder when they are positioned on the ring in an adjacent relation to each other, and $R^{12}$ and $R^{13}$ may form a condensed ring in combination with the remainder; and $R^{14}$ and $R^{15}$ may be the same or different and are each hydrogen, a hydrocarbon group or a substituted hydrocarbon group, provided that at least one of $R^{11}$, $R^{12}$, $R^{13}$, $R^{14}$ and $R^{15}$ contains a large group sufficient for preventing the above-described compound from moving in the layer; that is a nondiffusible group.

A radical providing non-diffusible property is one permitting the incorporation of the compound of the invention into hydrophilic colloids commonly used in the photographic material in a non-diffusible form. In general, organic radicals having a straight or branched aliphatic group, or a homocyclic or heterocyclic or aromatic group having from 8 to 20 carbon atoms are preferably used for that purpose. These radicals are bonded to the remaining molecule either directly or indirectly, for example, through —NHCO—, —NH-$SO_2$—, —NR— (wherein R is a hydrogen atom or an alkyl group), —O—, —S—, or —$SO_2$—. Radicals providing non-diffusible property may further have a group providing solubility in water, such as a sulfo group or a carboxyl group (which may be present in the form of anion). Diffusibility is determined by the whole molecular size of the compound. Therefore, in some cases, for example, in cases in which the whole molecular size is sufficiently large, a group having a short chain length is sufficient to be used as a "group providing diffusion resistance".

Compounds in which (Nuox)$^1$ and (Nuox)$^2$ are reduced into nucleophilic groups, (Nu)$^1$ and (Nu)$^2$, such as —GH and —$NH_2$, which fall within the scope of the general formulae (IIA) and (IIB) as described above, and their preparation methods are described in Belgian Pat. No. 861,241 claiming the priority based on German Patent Application No. P26 54 213.

The compounds of the general formulae (IIA) and (IIB) as described above can be prepared by treating the corresponding reduced compounds, i.e., compounds having a nucleophilic group (Nu) in an unoxidized state, in an excess of solvent, such as ethanol under reflux, with an oxidizing agent such as p-benzoquinone.

Other suitable oxidizing agents for use in the preparation of the compounds of the general formulae (IIA) and (IIB) include methyl-1,4-benzoquinone, 2,5-dimethyl-1,4-benzoquinone, octyl-1,4-benzoquinone, dodecyl-1,4-benzoquinone, 2,3,5-trimethyl-1,4-benzoquinone, 1,4-naphthoquinone, 2-methyl-1,4-naphthoquinone, 2-octyl-1,4-naphthoquinone, 2-dodecyl-1,4-naphthoquinone, 5,8-methano-1,4-naphthoquinone, 9,10-o-benzo-1,4-naphthoquinone, 2,6-dimethyl-1,4-benzoquinone, and 2,6-dichloro-1,4-benzoquinone.

A method of preparing the compounds of the general formulae (IIA) and (IIB) is described in Japanese Patent Application (OPI) No. 130927/79.

These quinone type compounds of the general formulae (IIA) and (IIB) to be used in the photographic element of the invention do not have a dye-releasing ability and should gain an ability to release imagewise dye by imagewise reduction.

This brings about an advantage that the formation of fog during storage or development is greatly reduced as compared with a photographic material as described in U.S. Pat. No. 3,980,479 in which the compound is incorporated in a reduced form from the beginning.

The dye moiety contained in the compound of this invention are derived from a hydrophilic dye or hydrophobic dye. It is preferably derived from a hydrophilic dye such as an azo dye, an azomethine dye, an anthraquinone dye, a naphthoquinone dye, a styryl dye, a nitro dye, a quinoline dye, a carbonyl dye, a phthalocyanine dye and a metal complex salts of them.

The dye precursor represented by the general formula (I) or (II) is typically a compound giving a dye by hydrolysis and examples of the dye precursor are acylated promotors of dyes (temporary short wave-type dye) as described in, for example, Japanese Patent Application (OPI) No. 125818/73 and U.S. Pat. Nos. 3,222,196 and 3,307,947. By temporarily shifting the absorption wave of the dye to a short wave side by acylation until at least exposure, the occurrence of desensitization based on the absorption of light by the color image-forming agent in the light-sensitive silver halide emulsion can be prevented. In addition, a dye showing a different hue between the case of being transferred onto a mordanting layer and the case of existing in a silver halide emulsion layer can be utilized. In addition, the dye moiety can have a group imparting water-solubility, such as a carboxy group and a sulfoamido group.

It is required for the immobile reducible dye-releasing agent of the invention to have the following characteristics.

(1) It is immobilized in a hydrophilic or hydrophobic binder, and only the dye released has mobility.

(2) It is superior in stability against heat and dye-releasing aids, and it does not release an image-forming dye till it is reduced.

(3) It is easy to synthesize.

Examples of the dyes utilized as the image-forming dyes in this invention are azo dyes, azomethine dyes, anthraquinone dyes, naphthoquinone dyes, styryl dyes, nitro dyes, quinoline dyes, carbonyl dyes, phthalocyanine dyes, etc., and typical examples of these dyes are shown below as color distinction. These dyes can be used in a form such that that absorption is temporarily shifted to a short wave length side, which can be recolored during development.

Yellow

-continued
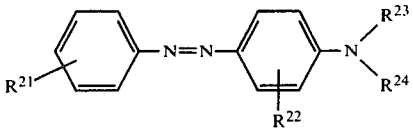
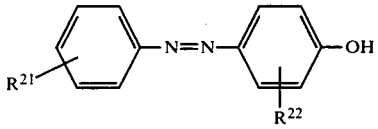
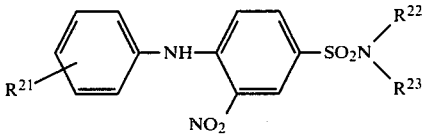
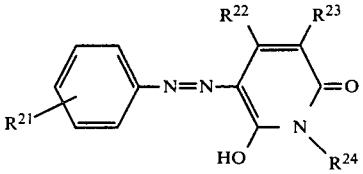
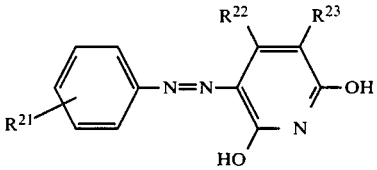
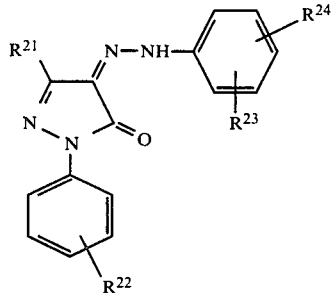
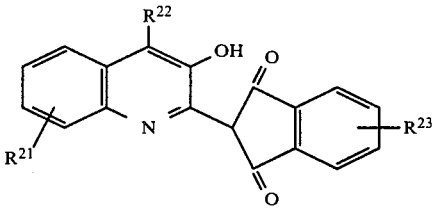
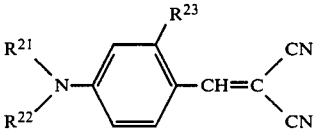
-continued
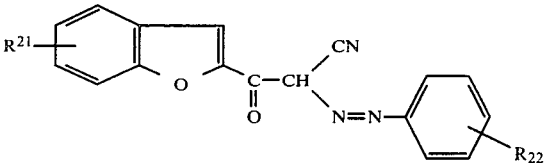
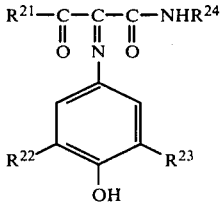
Magenta
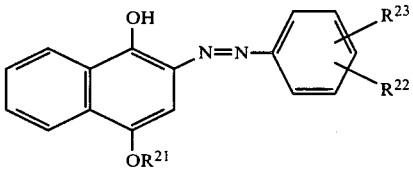
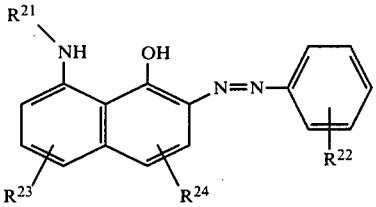
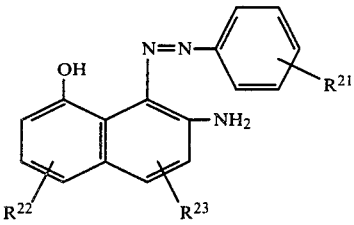
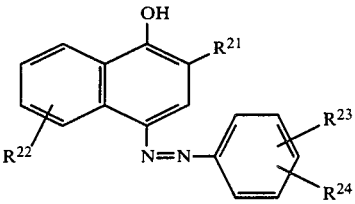
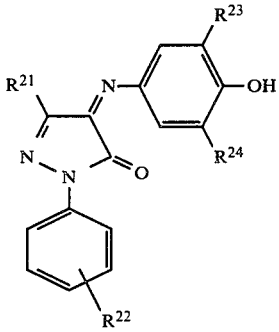

-continued
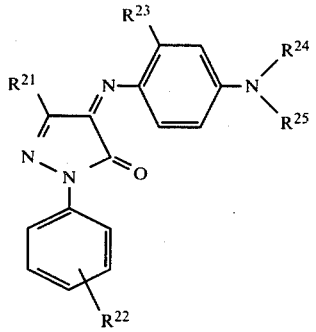
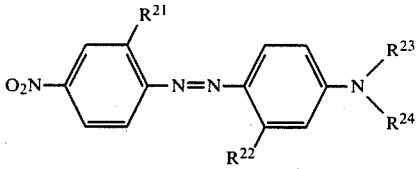
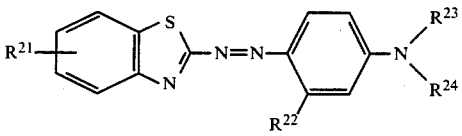
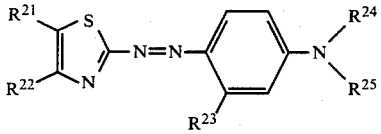
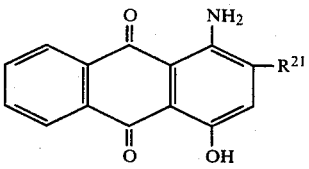
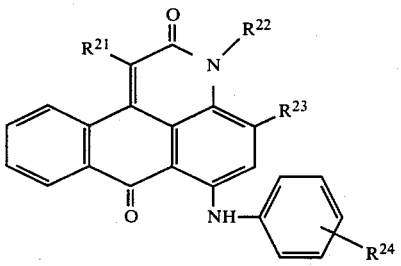
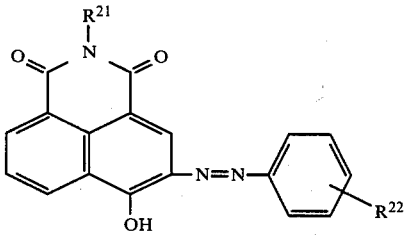
Cyan
-continued
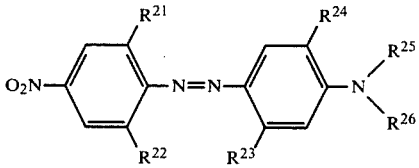
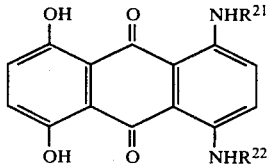
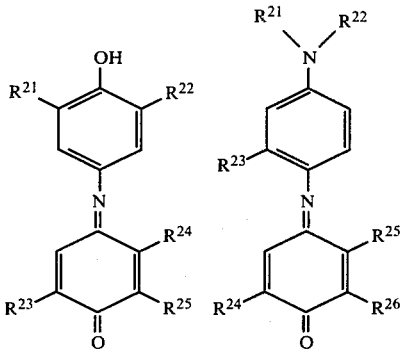
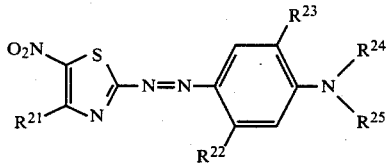
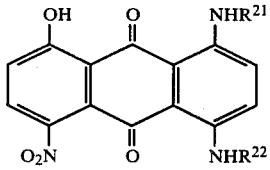
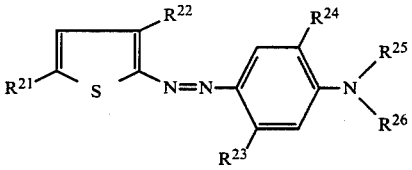
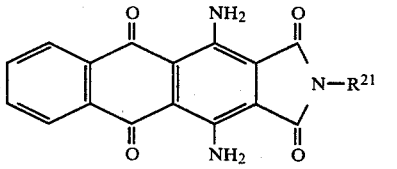

-continued

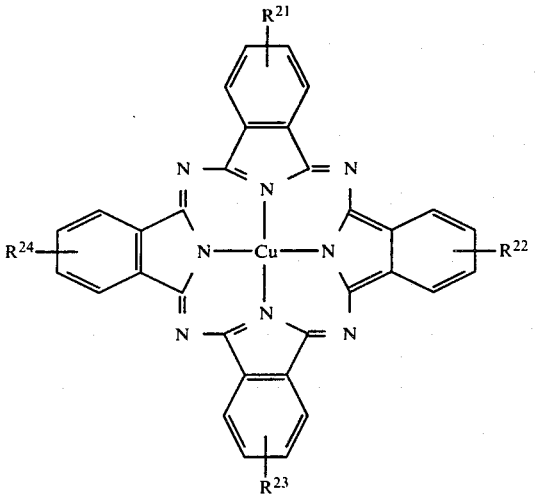

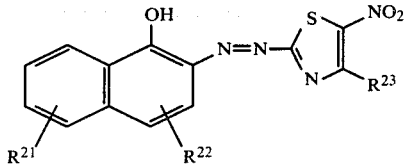

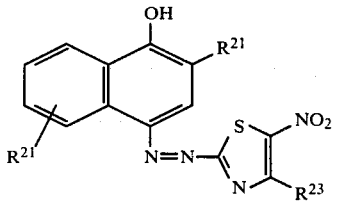

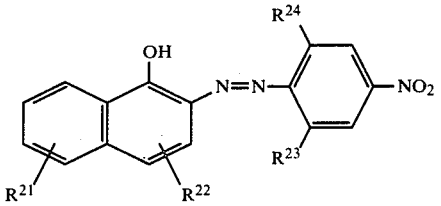

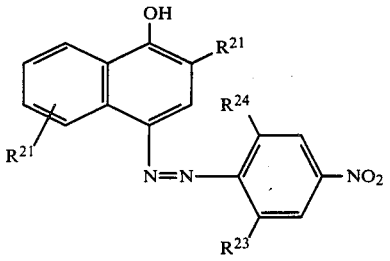

In the foregoing formulae, $R^{21}$ to $R^{26}$ each represents a hydrogen atom, an alkyl group, a cycloalkyl group, an aralkyl group, an alkoxy group, an aryloxy group, an aryl group, an acylamino group, an acyl group, a cyano group, a hydroxy group, an alkylsulfonylamino group, an arylsulfonylamino group, an alkylsulfonyl group, a hydroxyalkyl group, a cyanoalkyl group, an alkoxycarbonylalkyl group, an alkoxyalkyl group, an aryloxyalkyl group, a nitro group, a halogen atom, a sulfamoyl group, an N-substituted sulfamoyl group, a carbamoyl group, an N-substituted carbamoyl group, an acyloxyalkyl group, an amino group, a substituted amino group, an alkylthio group, or an arylthio group. Among these substituents, the alkyl group and aryl group may further be substituted with a halogen atom, a hydroxy group, a cyano group, an acyl group, an acylamino group, an alkoxy group, a carbamoyl group, a substituted carbamoyl group, a sulfamoyl group, a substituted sulfamoyl group, a carboxy group, an alkylsulfonamino group, an arylsulfonylamino group, or a ureido group.

Practical examples of compounds of this invention shown by general formula (IA) or (IB) are as follows.

IA-1

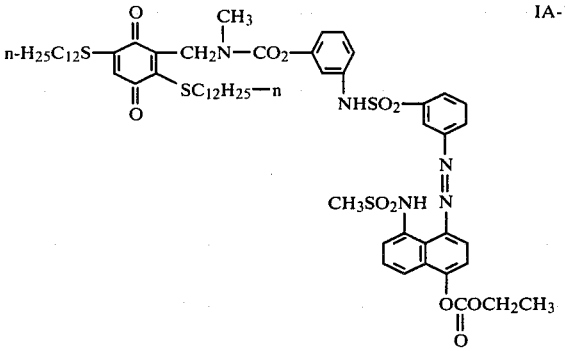

IA-2

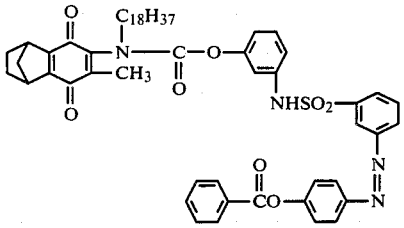

IA-3

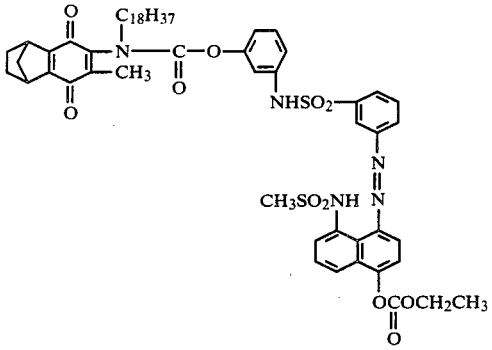

IA-4

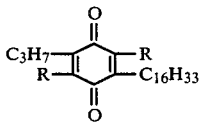

R =

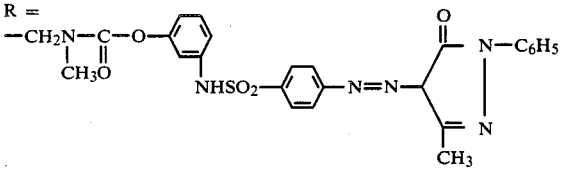

-continued
IA-5
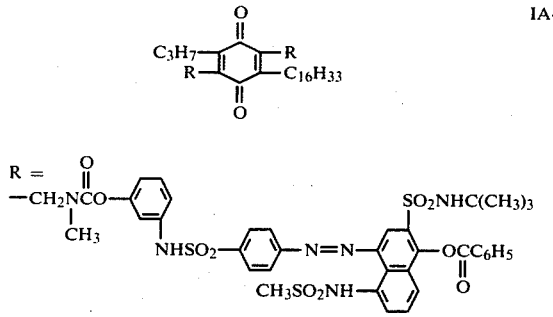
IA-6
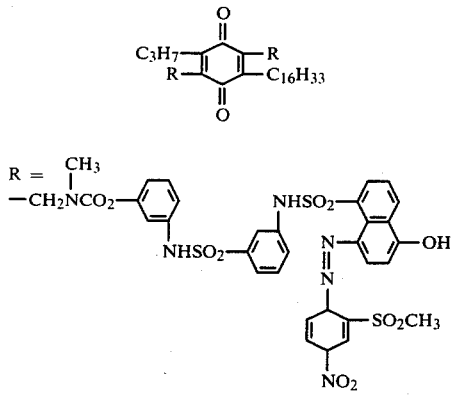
IA-7
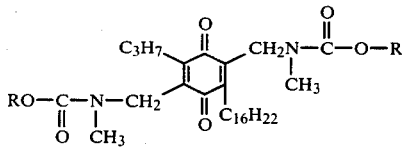
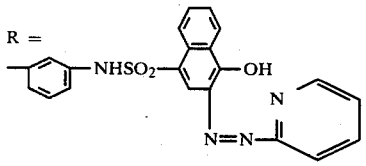
IA-8
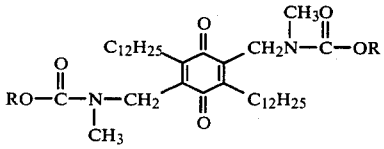
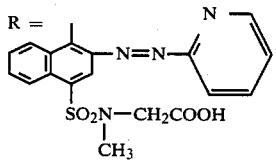
IA-9
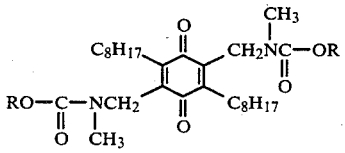
-continued
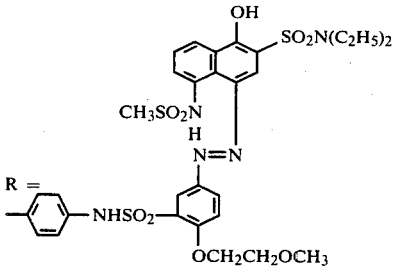
IB-1
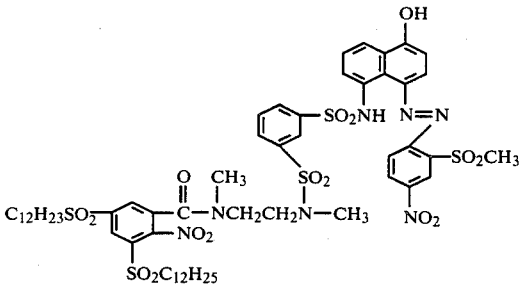
IB-2
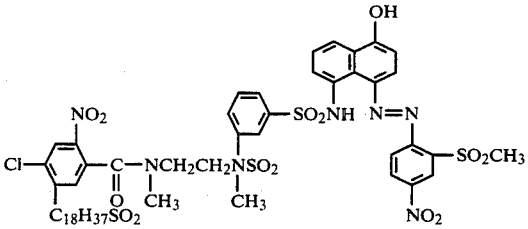
IB-3
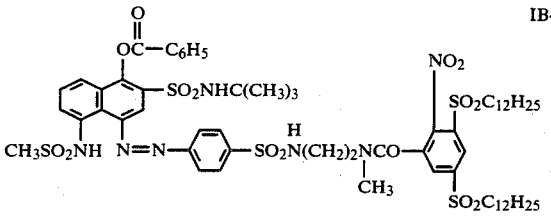
IB-4
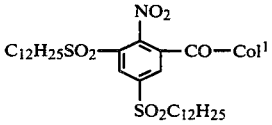
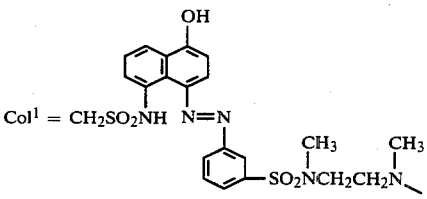
IB-5
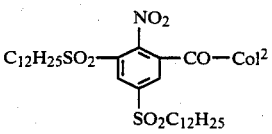

-continued
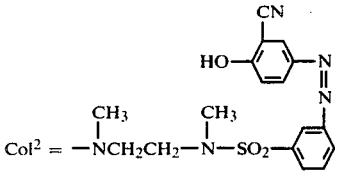
IB-6
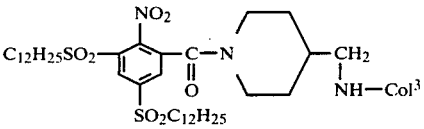
IB-7
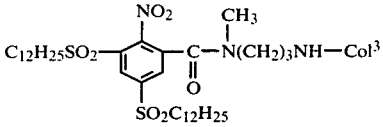
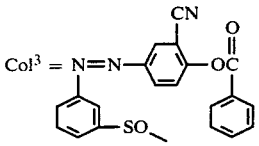
IB-8
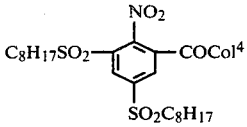
IB-9
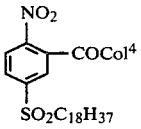
IB-10
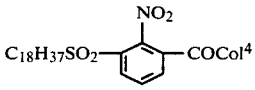
-continued
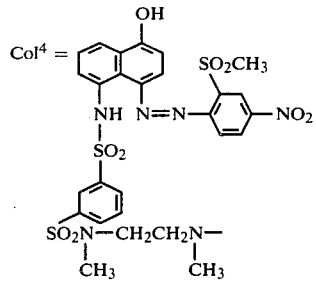
IB-11
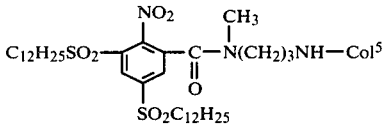
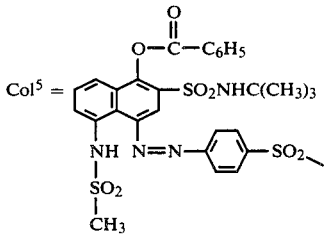
IB-12
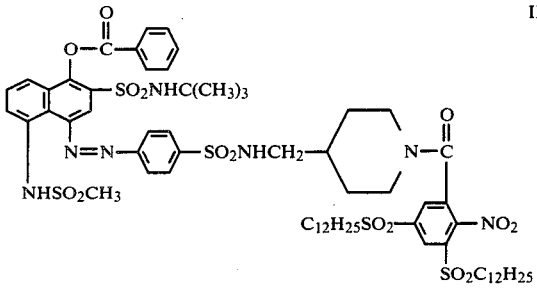
Typical examples of the compounds represented by the general formulae (IIA) and (IIB) include, as well as Compound II-(1) as described below, the oxidation products of Compounds III-(1) to III-(40) as described below (compounds resulting from the oxidation of the hydroxyl portion into quinone).
II-(1)
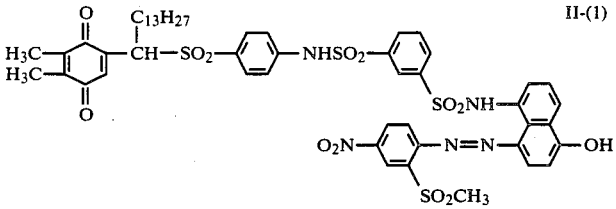
III-(1)
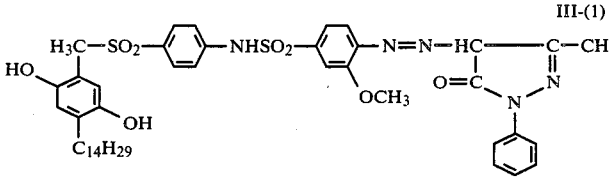
III-(2)
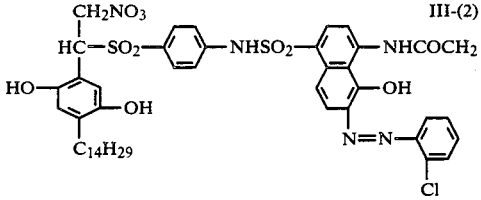

-continued
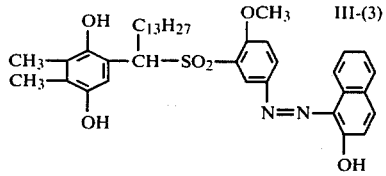
III-(3)
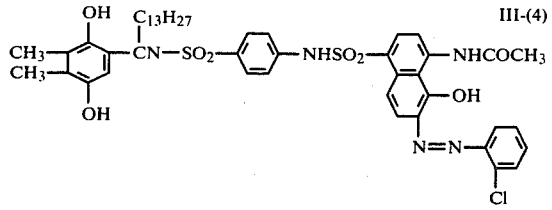
III-(4)
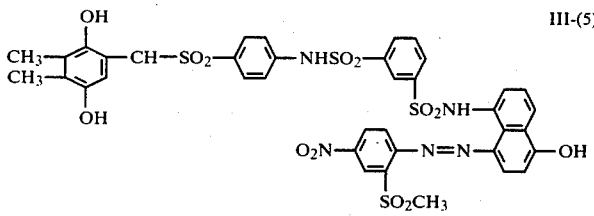
III-(5)
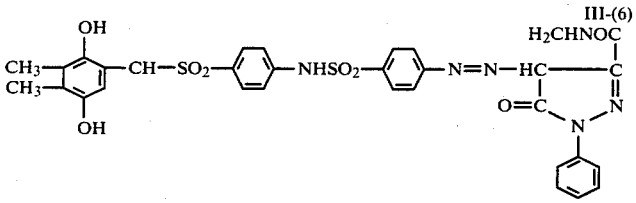
III-(6)
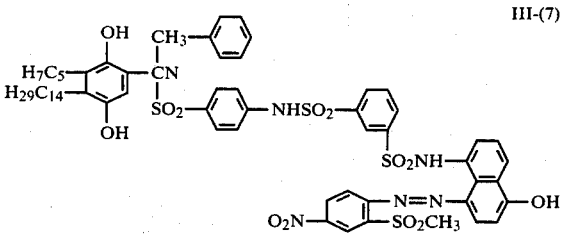
III-(7)
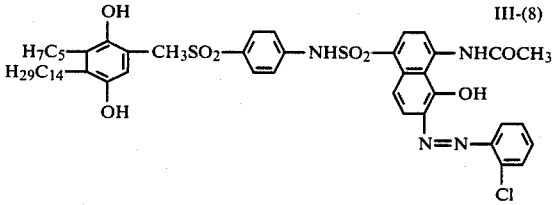
III-(8)
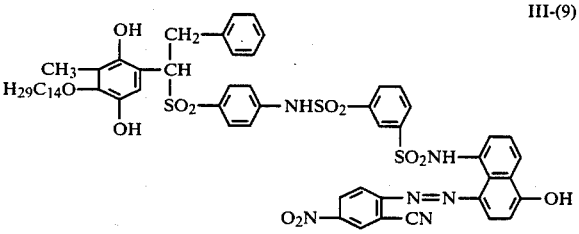
III-(9)
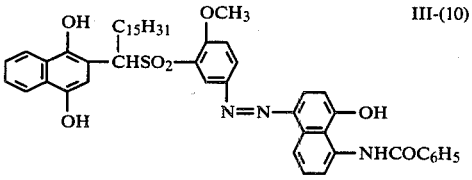
III-(10)
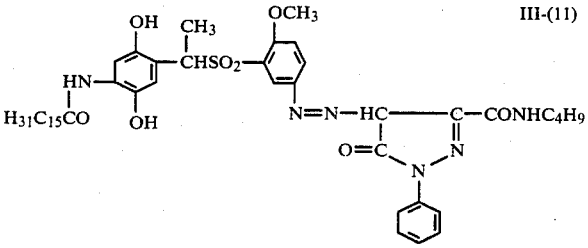
III-(11)
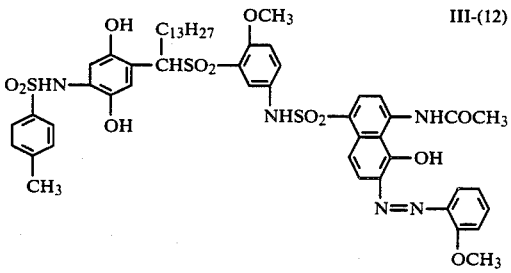
III-(12)

-continued
III-(13)
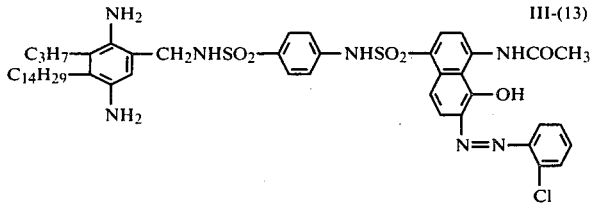
III-(14)
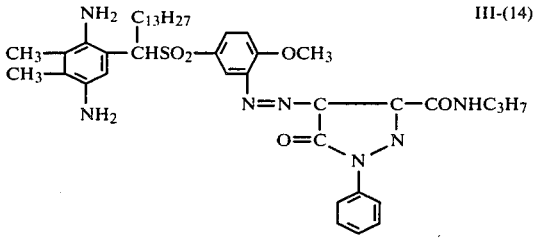
III-(15)
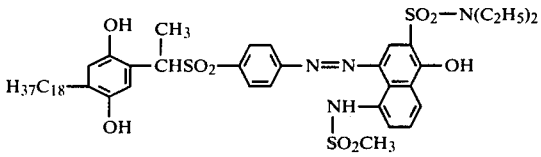
III-(16)
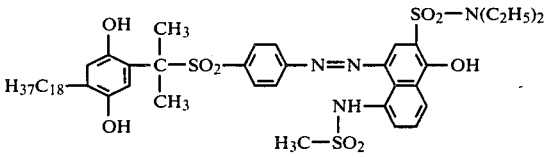
III-(17)
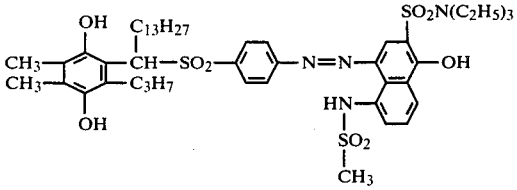
III-(18)
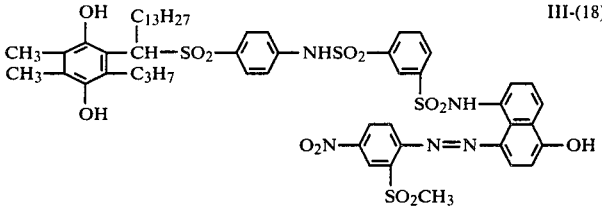
III-(19)
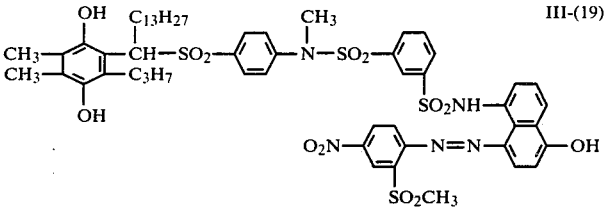
III-(20)
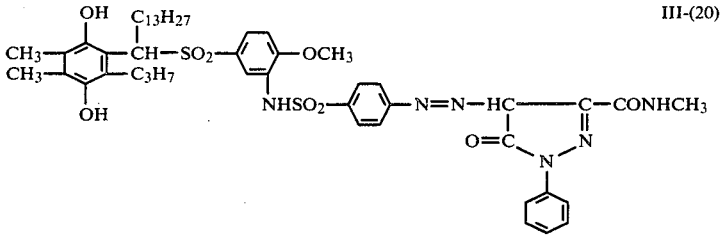
III-(21)
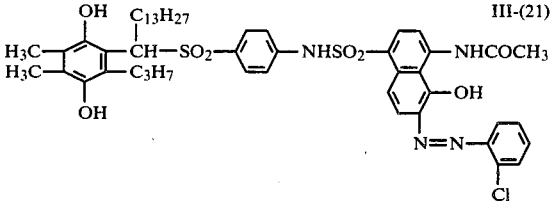
III-(22)
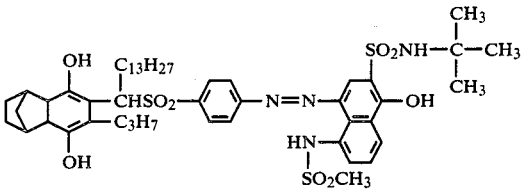
III-(23)
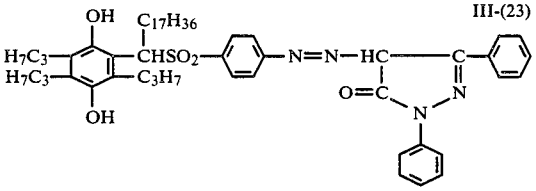
III-(24)
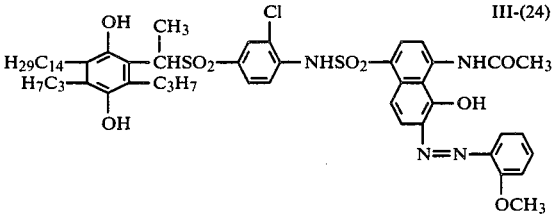

-continued
III-(25)
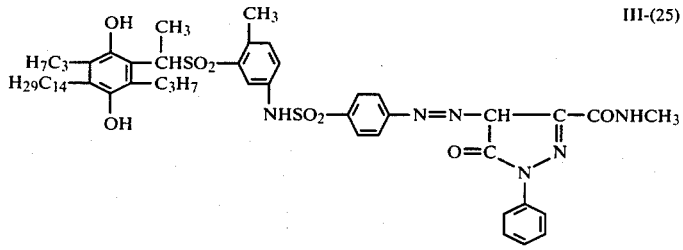
III-(26)
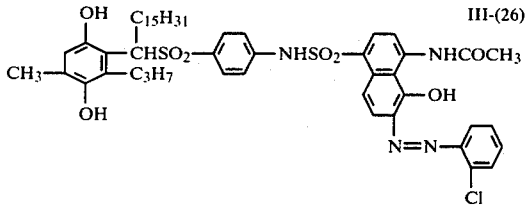
III-(27)
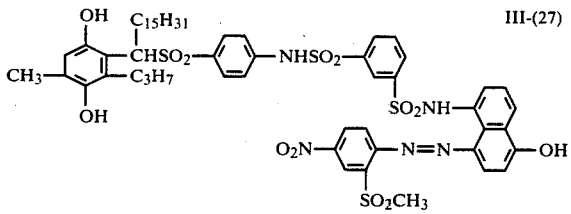
III-(28)
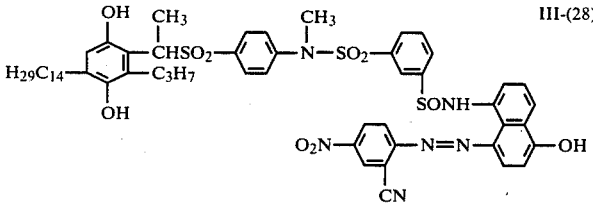
III-(29)
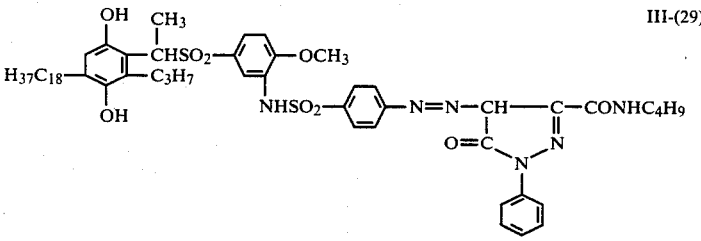
III-(30)
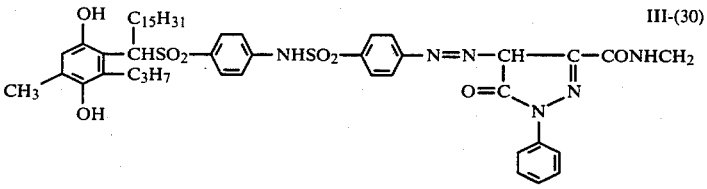
III-(31)
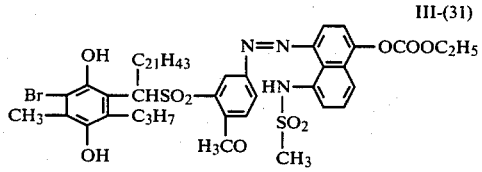
III-(32)
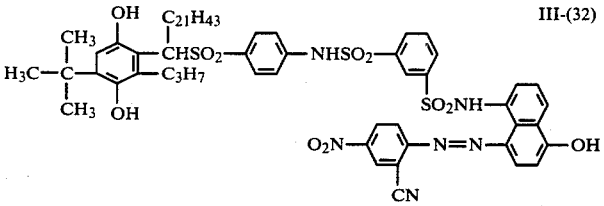
III-(33)
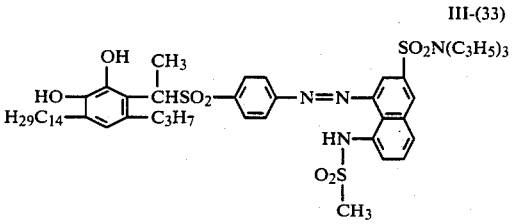
III-(34)
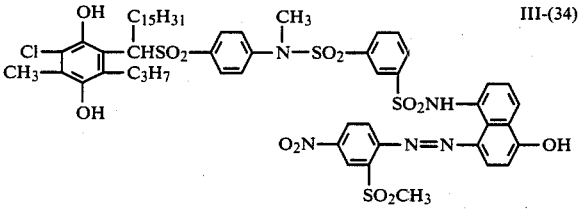

-continued

III-(35)

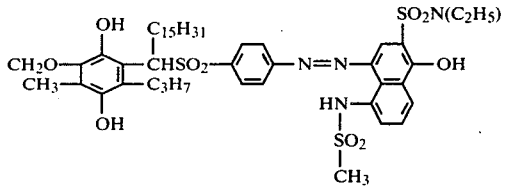

III-(36)

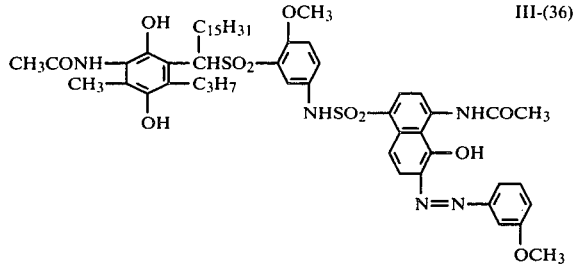

III-(37)

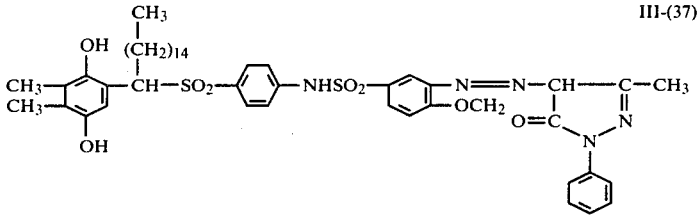

III-(38)

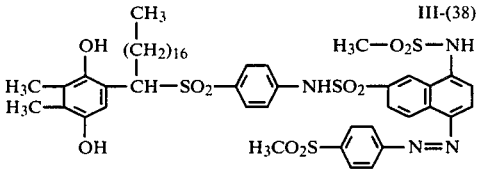

III-(39)

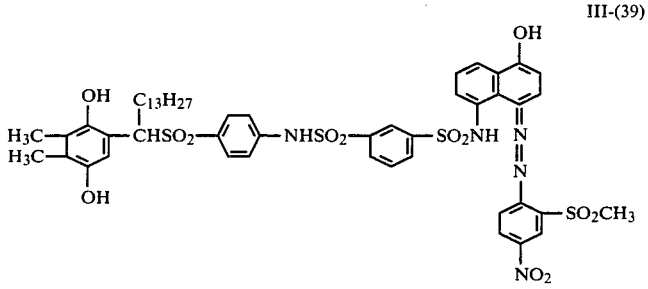

III-(40)

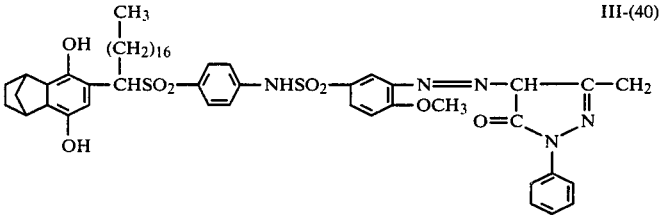

The compounds described in Japanese Patent Application (OPI) No. 110828/78 and German Patent Application (OLS) No. 3,008,588 are also effective as the reducible dye-releasing agents of the invention.

The compounds described in Japanese Patent Application (OPI) Nos. 111628/74 and 63618/76, *Research Disclosure,* 14447 (1976) No. 144, U.S. Pat. No. 4,108,850, and Japanese Patent Application (OPI) No. 69033/78 are also effective as the oxidizable dye-fixing agents of the invention.

In accordance with the present invention, the electron donor is used in combination with the reducible dye-releasing agent. This permits the imagewise release of mobile and hydrophilic dye.

The electron donor, when heated, undergoes an oxidation-reduction reaction with exposed silver halide before it reacts with the reducible dye-releasing agent and thus is broken in an imagewise form. Thereafter, the remaining electron donor reacts with the reducible dye-releasing agent.

Hence the mobile dye can be released as an inverse function of break-down of the electron donor of the reducible dye-releasing agent.

The term "electron donor" is used herein to mean a compound which is capable of reacting with the reducible dye-releasing agent contained in the photographic material, transferring an electron to the nucleophilic precursor group of the reducible dye-releasing agent.

For the electron donor it is required that its reaction rate with exposed silver halide is greater than that with the reducible dye-releasing agent. Preferably the rate of reaction between the electron donor and silver halide (as determined as an oxidation-reduction half-life time (redox t $\frac{1}{2}$)) is at least 5 times, preferably at least 10 times that between the electron donor and the reducible dye-releasing agent. In this case, the mobile component is released selectively in the image pattern. Such electron donors include ascorbic acid, trihydroxypyrimidine such as 2-methyl-4,5,6-trihydroxypyridine, and hydroxylamine such as diethylhydroxylamine.

In certain preferred embodiments, the dye-releasing activator (electron donor) is used in combination with an electron-transfer agent (herein referred to as ETA). Generally, the electron-transfer agent is a compound which is much better silver halide developer under the conditions of processing than the electron donor and, in those instances where the electron donor is incapable of or substantially ineffective in developing the silver halide, the ETA functions to develop the silver halide and provide a corresponding imagewise pattern of destroyed electron donor because the oxidized ETA readily accepts electrons from the donor. Generally, the useful ETA's will at least provide a faster rate of silver halide development under the conditions of processing when the combination of the electron donor and the ETA is employed as compared with the development rate when the electron donor is used in the process without the ETA. In highly preferred embodiments, the ETA has a slow redox t ½ ballast electron-accepting nucleophilic displacement (BEND) which is at least slower than the redox t ½ (half-life) of the electron donor with BEND and preferably at least 10 times slower; this embodiment allows a high degree of freedom in obtaining the optimum silver halide developing rates while also providing freedom in obtaining the optimum release rate with the BEND compounds.

Typical useful ETA compounds include hydroquinone compounds such as hydroquinone, 2,5-dichlorohydroquinone and 2-chlorohydroquinone; aminophenol compounds such as 4-aminophenol, N-methylaminophenol, 3-methyl-4-aminophenol and 3,5-dibromoaminophenol; catechol compounds such as catechol, 4-cyclohexylcatechol, 3-methoxy catechol and 4-(N-octadecylamino)catechol; phenylenediamine compounds such as N,N-diethyl-p-phenylenediamine, 3-methyl-N,N-diethyl-p-phenylenediamine, 3-methoxy-N-ethyl-N-ethoxy-p-phenylenediamine and N,N,N',N'-tetramethyl-p-phenylenediamine. In highly preferred embodiments, the ETA is a 3-pyrazolidone compound such as 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(3-chlorophenyl)-3-pyrazolidone, 1-(4-chlorophenyl)-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone and 5-methyl-3-pyrazolidone. A combination of different ETA's such as those disclosed in U.S. Pat. No. 3,039,869 can also be employed. Such developing agents can be employed in the liquid processing composition or may be contained, at least in part, in any layer or layers of the photographic element or film unit such as the silver halide emulsion layers, the dye image-providing material layers, interlayers or image-receiving layer. The particular ETA selected will, of course, depend on the particular electron donor and BEND used in the process and the processing conditions for the particular photographic element.

In the photographic element of the invention, the reducible dye-releasing agent of the invention is preferably used in combination with the electron donor.

In order to prevent color-mixing in a multi-color photographic element having yellow, magenta and cyan image dye-producing layers which are separated from each other, it is preferred for scavenger to be used in an intermediate layer separating the layers. To reduce color-mixing, it is possible to use a suitable scavenger for diffusing or partially diffusing compounds in an oxidized or reduced form.

In a preferred embodiment, a partially or completely ballasted electron donor is incorporated in a layer unit. This permits effective separation. If a substantially immobile electron donor is used, diffusion between layers is effectively reduced.

However, the compound remains in the layer unit while keeping its effectiveness and transfers an electron to the reducible dye-releasing compound in close contact thereto.

After the image-forming process is substantially completed, even if a small amount of electron donor migrates into the adjacent layer unit, it is considered not to substantially exert adverse influences on the image.

When very high image-form separation is needed, e.g., in a multi-color photographic element, a heat-decomposable electron donor precursor is used in combination with the respective reducible dye-releasing compound. In general, decomposition of the electron donor precursor into the corresponding electron donor occurs at a limited speed. When the electron donor is formed, it reacts immediately with an oxidized product of an electron transfer agent (ETA) formed by a silver halide development reaction, or with developable silver halide.

ETA is generated and can develop a larger amount of silver halide. In areas where development occurs, the electron donor is decomposed at the same speed as that at which it is formed by decomposition. In this way, the electron donor formed by decomposition reacts with the reducible dye-releasing agent. Thus, the electron donor is effective only in areas which are not developed and releases a diffusing photographically useful group, e.g., diffusing image dye, in the undeveloped areas. In a most preferred embodiment, the heat-developable electron donor precursor has a ballast group of sufficiently large size for making it immobile particularly when it is used in a multi-color photographic element.

When the heat-decomposable electron donor precursor is used, the rate of decomposition of the electron donor precursor into the corresponding electron donor can be made a step of controlling the rate at which the diffusing photographically useful group is released from the reducible dye-releasing agent. This decomposition rate can exert influences on the rate of development of silver halide. This is applicable particularly to a case in which a small amount of ETA is used. Thus, those heat-decomposable precursors are generally used which provide a redox t ½ with a compound which is longer than the redox t ½ with the ETA, and is generally longer than 5 seconds and preferably longer than 10 seconds with the respective compounds.

It is necessary to understand that the rate of cross-oxidation between the electron donor and the reducible dye-releasing agent can become a step of controlling the rate of release of the photographically useful group.

The electron donor is generally used in the photographic element in such amounts that the ratio of the electron donor to the reducible dye-releasing agent is from 1:2 to 6:1 and preferably from 1:1 to 2:1.

Preferred examples of the heat-decomposable electron donor precursors are those having the following formula:

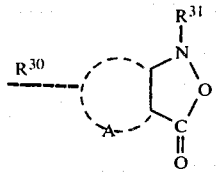

wherein:

A is a group containing an atomic group necessary for forming a 5 or 6 atom-containing aromatic ring in combination with the remaining portion and preferably a carbocyclic aromatic ring;

$R^{30}$ is a hydrogen atom, or at least one group containing from 1 to 30 carbon atoms, preferably having a large size sufficient for making the compound immobile in the binder layer of the photographic element, for example, containing from 8 to 30 carbon atoms, and includes an N-substituted carbamoyl group such as N-alkylcarbamoyl, an alkylthioether group, an N-substituted sulfamoyl group such as N-alkylsufamoyl and an alkoxycarbonyl group; and $R^{31}$ is a substituted or unsubstituted alkyl group containing from 1 to 30 carbon atoms, or a substituted or unsubstituted aryl group containing from 6 to 30 carbon atoms, and preferably a methyl group.

Typical examples of the compounds of the above formula are shown below.

ED-1

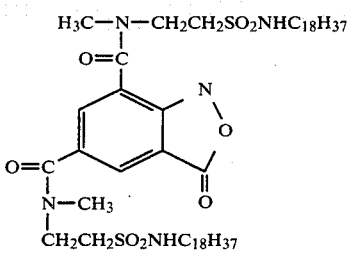

ED-2

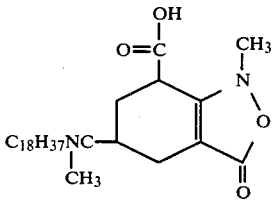

ED-3

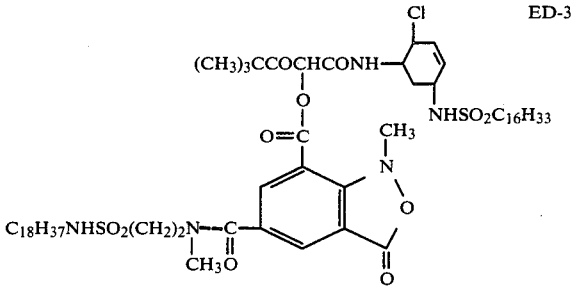

-continued

ED-4

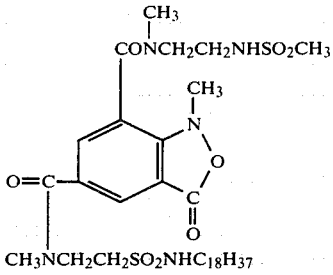

ED-5

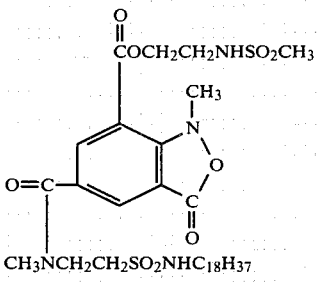

ED-6

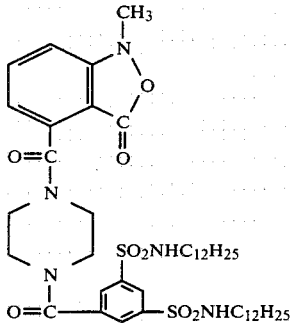

ED-7

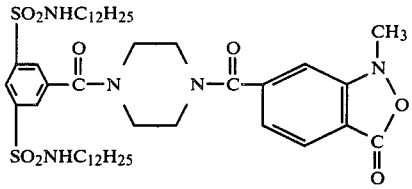

In other examples, other electron donors which are decomposable at the time of heating can be used. Examples are shown below.

ED-8

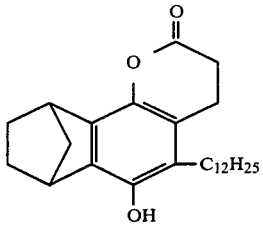

ED-9

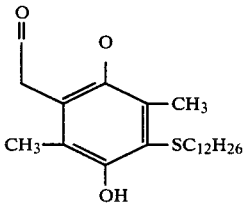

-continued

ED-10

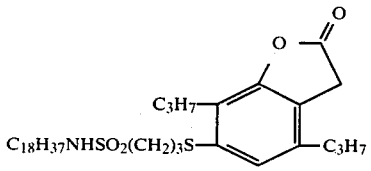

ED-11

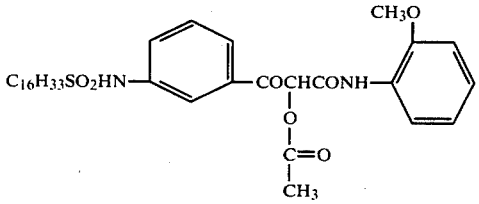

ED-12

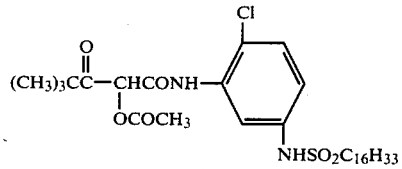

ED-13

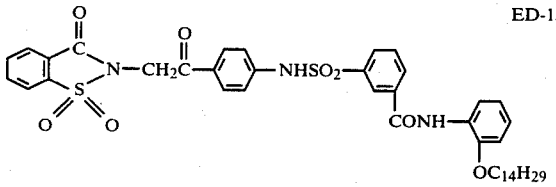

ED-14

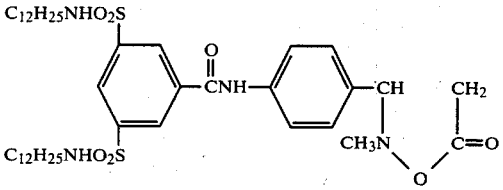

In still other examples, the electron donors can exist in the form of keto type, such as protohydroquinone. They are converted into the corresponding phenol type compounds, forming the electron donors. Compounds of this type are shown below.

ED-15

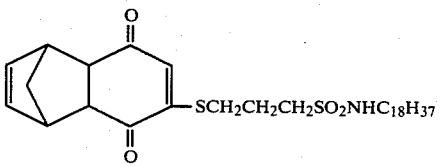

Some compounds are preferably at least immobile in the layer of the photographic element although they are not precursors. Typical examples of the compounds of this type are shown below.

ED-16

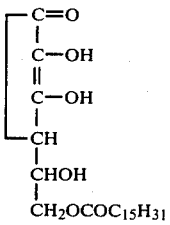

ED-17

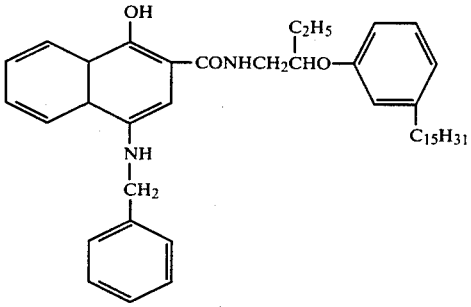

ED-18

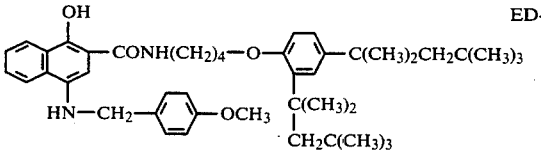

ED-19

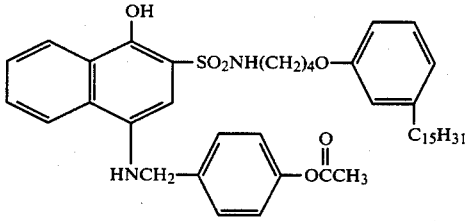

ED-20

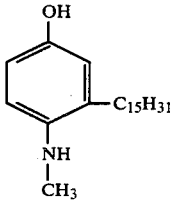

ED-21

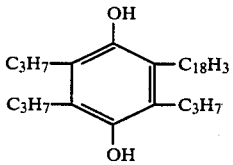

ED-22

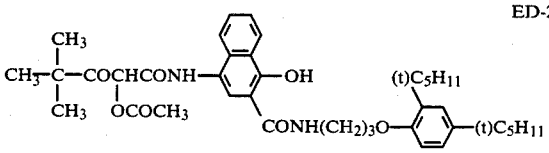

-continued

ED-23

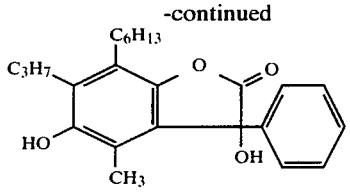

The above-described electron donor precursors are advantageous in that they are decomposable on heating at low temperatures if they are bases at the time of heating.

In addition to Compounds ED-1 to ED-23 as described above, the compounds described in U.S. Pat. Nos. 4,263,393, 4,278,750 and West German Patent Application (OLS) No. 3,006,268 are also effective as electron donors to be used in combination with the reducible dye-releasing agent.

The image-forming dyes released from the compounds used in this invention are desired to have the properties; (1) the dyes have hues suitable for color reproduction, (2) the molecular extinction coefficient is large, (3) the dye is stable to light, heat, and the dye-releasing activator and other additives contained in the system, (4) the dye can be easily prepared, (5) the dye has a hydrophilic property and has a mordanting property, especially, for a cationic mordanting layer, etc.

As the silver halide used in this invention, there are silver chloride, silver chlorobromide, silver chloroiodide, silver bromide, silver iodobromide, silver chloroiodobromide. silver iodide, etc.

The particularly preferred silver halide in this invention contains a silver iodide crystal in a part of the silver halide grain. That is, the silver halide which shows the pattern of pure silver iodide in X-ray diffraction of it is particularly preferred.

In a photographic material a silver halide containing two or more halogen atoms is usually used. In ordinary silver halide emulsions, the silver halide grains form complete mixed crystals. For example when the X-ray diffraction of the grains of a silver iodobromide emulsion is measured, the patterns of silver iodide crystals and silver bromide crystals do not appear but the X-ray pattern appears at the positions corresponding to the mixing ratio of the both crystals and intermediate of them.

Particularly preferred silver halide in this invention is silver chloroiodide, silver iodobromide, and silver chloroiodobromide each containing silver iodide crystals in the grains.

Such a silver halide may be obtained in the following manner. For example, silver iodobromide can be obtained by adding an aqueous silver nitrate solution to an aqueous potassium bromide solution to first form silver bromide grains and thereafter adding thereto potassium iodide.

The mean grain size of the silver halide used in this invention is from 0.001 μm to 10 μm, preferably from 0.001 μm to 5 μm.

Also, a mixture of two or more kinds of silver halides each having different mean grain size and/or halogen component may be used as the silver halide in this invention.

The silver halide emulsion used in this invention may be used as it is or may be chemically sensitized by a chemical sensitizer such as compounds of sulfur, selenium, tellurium, etc., or the compounds of gold, platinum, palladium, rhodium, iridium, etc.; a reducing agent such a tin halide, etc.; or a combination of them. The details of these chemical sensitizations are described in, for example, T. H. James; "The Theory of the Photographic Process", 4th Ed., Chapter 5, pages 149–169.

A silver halide and the dye-providing material may be incorporated in a same layer of the light-sensitive material of this invention or a layer containing a silver halide may be formed on or under a layer containing the dye-providing material.

It is preferred that the photosensitive silver halide is coated at 50 mg to 10 g/m$^2$ based on the silver.

In this invention the use of an organic silver salt oxidizing agent is advantageous since in this case the oxidation reduction reaction is accelerated and the maximum coloring density of dye is increased.

When the light-sensitive material containing the organic silver salt oxidizing agent is heated to a temperature of higher than 80° C., preferably higher than 100° C., more preferably higher than 110° C., the organic silver salt oxidizing agent reacts with the foregoing image-forming material upon that the silver halide is reduced to silver to form a silver image at the corresponding position where the silver halide is reduced.

Examples of such an organic silver salt oxidizing agent are as follows.

That is, they are silver salts of organic compounds having a carboxy group and typical examples are silver salts of aliphatic carboxylic acids and silver salts of aromatic carboxylic acids.

Examples of the silver salts of aliphatic carboxylic acids are silver salts of behenic acid, stearic acid, oleic acid, lauric acid, capric acid, myristic acid, palmitic acid, maleic acid, fumaric acid, tartaric acid, furoic acid, linolic acid, adipic acid, sebacic acid, succinic acid, acetic acid, butyric acid, camphoric acid, etc. Also, the foregoing silver salts substituted with a halogen atom or a hydroxy group are useful.

Examples of the silver salts of aromatic carboxylic acids or other carboxy group-having compounds are silver salts of benzoic acid, a substituted benzoic acid such as 3,5-dihydroxybenzoic acid, o-methylbenzoic acid, m-methylbenzoic acid, p-methylbenzoic acid, 2,4-dichlorobenzoic acid, acetamidobenzoic acid, and p-phenylbenzoic acid; gallic acid, tannic acid, phthalic acid, terephthalic acid, salicylic acid, phenylacetic acid, and pyromellitic acid, the silver salts of 3-carboxymethyl-4-methyl-4-thiazolin-2-thion described in U.S. Pat. No. 3,785,830, and the silver salts of aliphatic carboxylic acids having a thioether group described in U.S. Pat. No. 3,330,663.

Other examples of the organic silver salt oxidizing agent are the silver salts of a compound having a mercapto group or a thion group and the derivatives thereof.

For example, there are silver salts of 3-mercapto-4-phenyl-1,2,4-triazole, 2-mercaptobenzimidazole, 2-mercapto-5-aminothiadiazole, 2-mercaptobenzthiazole, 2-(s-ethyl glycol amido)-benzthiazole, thioglycolic acid described in Japanese Patent Application (OPI) No. 28,221/73 (e.g., s-alkylthioglycolic acid, the carbon atom number of the alkyl group being 12 to 22), dithiocarboxylic acid (e.g., dithioacetic acid), thioamide, 5-carboxy-1-methyl-2-phenyl-4-thiopyridine, mercaptotrazine, 2-mercaptobenzoxazole, and mercaptoxadiazole, the silver salts described in U.S. Pat. No. 4,123,274 (e.g., the silver salt of 3-amino-5-benzylthio- 1,2,4-triazole which is a 1,2,4-mercaptotriazole derivative), and the silver salts of thion compounds such as the silver salt of 3-(2-carboxyethyl)-4-methyl-4-thiazolin-2-thion described in U.S. Pat. No. 3,301,678.

Other examples of the organic silver salt oxidizing agent are the silver salts of the compounds having an imino group. For example, there are silver salts of benzotriazole and the derivatives thereof as described in Japanese Patent Publication Nos. 30,270/69 and 18,416/70, for example, the silver salt of benzotriazole, the silver salts of alkyl-substituted benzotriazoles such as the silver salt of methylbenzotriazole, etc., the silver salts of halogen-substituted benzotriazoles such as the silver salt of 5-chlorobenzotriazole, etc.; the silver salts of carboimidobenzotriazoles such as the silver salt of butylcarboimidobenzotriazole, etc., the silver salt of 1,2,4-triazole and the silver salt of 1-H-tetrazole as described in U.S. Pat. No. 4,220,709; the silver salt of carbazole, the silver salt of saccharin, and the silver salts of imidazole and imidazole derivatives.

Also, the organic metal salts such as the silver salts and copper stearate described in "Research Disclosure", Vol. 170, No. 17019, June 1978, can be used as the organic metal oxidizing.

The heat developing mechanism of this invention during heat has not yet been clarified but is considered to be as follows.

That is, when a silver halide light-sensitive material is exposed to light, a latent image is formed with the silver halide. The formation of latent image is described in, for example, T. H. James, "The Theory of the Photographic Process", 3rd Ed., pages 105–148.

An electron transfer agent is released when the light-sensitive material is heated. This electron transfer agent reduces silver halide or silver halide and an organosilver salt oxidizing agent with the above-formed latent image nuclei as a catalyst, forming metallic silver, while at the same time it is oxidized. This reaction proceeds quickly even at low heating temperatures if a base is present at the time of heating. For this reason, the presence of a base is advantageous in the practice of the invention. The thus-oxidized electron transfer agent undergoes a redox reaction with an electron donor, resulting in the oxidation of the electron donor. On the other hand, the unreacted electron donor undergoes a reaction with a reducible dye-releasing agent, resulting in the reduction of the reducible dye-releasing agent. At this point, an intramolecular or intermolecular nucleophilic reaction occurs, releasing a dye.

In a case in which an electron donor is not used, the reducible dye-releasing agent is reduced by the remaining electron transfer agent.

On the other hand, when an electron transfer agent is not used, the electron donor which is to be released on heating, when heated, reduces the silver halide or silver halide and the organosilver salt oxidizing agent with the latent image nuclei as a catalyst, while at the same time it is oxidized. The reducible dye-releasing agent is reduced by the remaining electron donor.

The amounts of the electron donor and electron transfer agent added are each from 0.001 to 10 moles, preferably from 0.01 to 2 moles per mole of silver, and from 0.01 to 10 moles, preferably from 0.1 to 5 moles per mole of the reducible dye-releasing agent.

The amount of the reducible dye-releasing agent added is preferably from 0.01 to 4 moles per mole of silver halide.

The dye-providing material of this invention can be incorporated in the layer or layers of a light-sensitive material by, for example, the method described in U.S. Pat. No. 2,322,027. In this case an organic solvent having a high boiling point (a boiling point of higher than about 160° C.) and an organic solvent having a low boiling point as shown below can be used. For example, there are organic solvents having a high boiling point such as phthalic acid alkyl esters (e.g., dibutyl phthalate, dioctyl phthalate, etc.), phosphoric acid esters (e.g., diphenyl phosphate, triphenyl phosphate, tricresyl phosphate, dioctylbutyl phosphate, etc.), citric acid esters (e.g., tributyl acetylcitrate, etc.), benzoic acid esters (e.g., octyl benzoate, etc.), alkylamide (e.g., diethyl laurylamide), fatty acid esters (e.g., dibutoxyethyl succinate, dioctyl azelate, etc.), trimesic acid esters (e.g., tributyl trimesate, etc.), etc., and low boiling organis solvents having boiling points of about 30° C. to 160° C., such as lower alkyl acetates (e.g., ethyl acetate, butyl acetate, etc.), ethyl propionate, secondary butyl alcohol, methyl isobutyl ketone, β-ethoxyethyl acetate, methyl cellosolve acetate, cyclohexanone, etc.

The dye-providing material of this invention is dissolved in the foregoing organic solvent and is dispersed in an aqueous solution of a hydrophilic colloid. The foregoing organic solvent having a high boiling point and that having a low boiling point may be used as a mixture of them.

The amount of the organic solvent having a high boiling point used in this invention is less than 10 g, preferably 0.01 g to 5 g per gram of the dye-providing material.

Also, the dispersion methods using polymers as described in Japanese Patent Publication No. 39853/76 and Japanese Patent Application (OPI) No. 59943/76 can be used for incorporating the dye-providing material of this invention in a light-sensitive material. Also, in the case dispersing the dye-providing material in a hydrophilic colloid solution, various surface active agents as shown hereafter can be used.

The photographic silver halide emulsions or other hydrophilic colloid layers of the light-sensitive material of this invention may contain various surface active agents for various purposes such as coating aid, static prevention, improvement of sliding property, dispersion by emulsification, sticking prevention and improvement of photographic properties (e.g., acceleration of development, gradation improvement sensitization, etc.).

Examples of the surface active agents used for the purposes are nonionic surface active agents such as saponin (steroid series), alkylene oxide derivatives (e.g., polyethylene glycol, polyethylene glycol/polypropylene glycol condensation product, polyethylene glycol aklyl ethers, polyethylene glycol alkyaryl ethers, polyethylene glycol esters, polyethylene glycol sorbitan esters, polyalkylene glycol alkylamines, polyalkylene glycol alkylamides, and polyethylene oxide addition products of silicone), glycidol derivatives (e.g., alkenylsuccinic acid polyglyceride, alkylphenol polyglyceride, etc.), fatty acid esters of polyhydric alcohol, alkyl esters of sugar, etc.; anionic surface active agents having an acid group (e.g., a carboxy group, a sulfo group, a phospho group, a sulfuric acid ester group, a phosphoric acid ester group, etc.), such as alkyl carboxylates, alkyl sulfonates, alkylbenzene sulfonates, alkylnaphthalene sulfonates, alkylsulfonic acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; amphoteric surface active agents such as aminoacids, aminoalkylsulfonic acids, aminoalkylsulfuric acid esters, aminoalkylphosphoric acid esters, alkylbetains, amine oxides, etc.; and cationic surface active agents such as alkylamines, aliphatic quaternary ammonium salts, aromatic quaternary ammonium salts, heterocyclic quaternary ammonium salts (e.g., pyridinium, imidazolium, etc.), phosphonium salts or sulfonium salts containing aliphatic ring or heterocyclic ring.

Among the foregoing surface active agents, polyethylene glycol type nonionic surface active agents having a repeating unit of ethylene oxide in the molecules are preferred for use in the light-sensitive materials.

It is necessary that the silver halide and the organic silver salt oxidizing agent which become the development initiating points exist within a substantially effective distance. It is preferred that the silver halide and the organic silver salt oxidizing agent exist in the same layer of the light-sensitive material.

For incorporating the silver halide and the organic silver oxidizing agent in a same layer, a coating composition for the layer containing a mixture of both the components may be prepared and in this case, it is effective to mix both the components in a ball mill for a long period of time. Also, it is effective for the purpose to add a halogen-containing compound to the organic silver salt oxidizing agent to form silver halide from silver derived from the organic silver salt oxidizing agent and the halogen from the halogen-containing compound.

Methods of preparing the silver halide and the organic silver salt oxidizing agent and methods of mixing them are described in, for example, "Research Disclosure", No. 17029; Japanese Patent Application (OPI) Nos. 32928/75 and 42529/76; U.S. Pat. No. 3,700,458; and Japanese Patent Application (OPI) Nos. 13224/74 and 17216/75.

The proper amount of the organic silver salt oxidizing agent which is used, if necessary, in this invention, is usually from 0.01 mole to 200 moles per mole of the silver halide and in the case of coating the coating composition containing both the silver halide and the organic silver salt oxidizing agent, it is proper that the coverage of both the components is usually 50 mg to 10 $g/m^2$ based on the total amount of silver in both of the components.

The photosensitive silver and the organic silver salt oxidizing agent in this invention are dispersed in the following binder or binders. Also, the dye-providing material is dispersed in a binder described below.

The binders used in photographic materials used in this invention can be used solely or as a combination of them. Hydrophilic binders are used in this invention. Typical hydrophilic binders are transparent or translucent hydrophilic colloids and examples of the hydrophilic binders are natural materials, e.g., proteins such as gelatin, gelatin derivatives, cellulose derivatives, etc., and polysaccharides such as starch, gum arabic, etc., and synthetic polymers as water-soluble polyviyl compounds such as polyvinylpyrolidone, acrylamide polymers, etc. As other synthetic polymers, there are dispersed vinyl compounds in a latex form for increasing, in particular, the dimensional stability of photographic materials.

For the image-forming process of this invention, various dye-releasing activators can be used. The dye-releasing activator accelerates the oxidation-reduction reaction of the dye-providing material with the silver halide and/or the organic silver salt oxidizing agent, or nucleophilically acts to the dye-providing material in the dye-releasing reaction which follows by the oxidation-reduction reaction to accelerate the release of dye. A base or a base-releasing agent is used as the dye-releasing activator. In this invention it is particularly advantageous to use the dye-releasing activator for accelerating the reaction.

Preferred examples of the bases used as the dye-releasing activator in this invention are amines such as trialkylamines, hydroxylamines, aliphatic polyamines, N-alkyl-substituted aromatic amines, N-hydroxyalkyl-substituted aromatic amines, and bis[p-(dialkylamino)-phenyl]methanes. Also, other materials useful as the dye-releasing activator are betaine, tetramethylammonium iodide, and diaminobutane dihydrochloride described in U.S. Pat. No. 2,410,644 and the organic compounds such as urea and aminoacid, e.g., 6-aminocaproic acid described in U.S. Pat. No. 3,506,444.

A base-releasing agent is a compound releasing a basic component by heating. Examples of typical base-releasing agents are described in U.K. Pat. No. 998,949. Preferred base-releasing agents are the salts of carboxylic acids and organic bases. Examples of useful carboxylic acids are trichloroacetic acid, trifluoroacetic acid, etc., and examples of useful bases are guanidine, piperidine, morpholine, p-toluidine, 2-picoline, etc. Guanidine trichloroacetate described in U.S. Pat. No. 3,220,846 is particularly useful. Also, the aldonamides described in Japanese Patent Application (OPI) No. 22625/75 is preferably used since they are decomposed at high temperature to form bases.

These dye-releasing activators can be used over a wide range of amounts. It is advantageous that the molar ratio of the dye-releasing activator to the total amount of silver in the silver halide and the organic silver oxidizing agent is 1/100 to 100/1, particularly 1/20 to 20/1.

In this invention the use of a water-releasing compound is advantageous since the dye-releasing reaction is accelerated by the use of the compound.

A water-releasing compound is a compound which is decomposed during the heat development to release water and is providing a vapor pressure of higher than $10^{-5}$ Torr in the photographic material at a temperature of 100° C. to 200° C. These compounds are known in copy printing for fibers and useful examples of them are $NH_4Fe(SO_4)_2.12H_2O$, etc., described in Japanese Patent Application (OPI) No. 88386/75.

In the image-forming process of this invention a compound which can accelerate the development and at the same time can stabilize the image formed can be used. Preferred examples of these compounds are isothiuroniums such as 2-hydroxyethyl isothiuronium trichloroacetate described in U.S. Pat. No. 3,301,678, bisisothiuroniums such as 1,8-(3,6-dioxaoctane)-bis(isothiuronium.trifluoroacetate) described in U.S. Pat. No. 3,669,670, thiol compounds described in West German Patent Application (Offenlegunsschrift) No. 2,162,714, thiazolium compounds such as 2-amino-2-thiazolium.-trichloroacetate, 2-amino-5-bromoethyl-2-thiazolium.-trichloroacetate, etc., described in U.S. Pat. No. 4,012,260, compounds having α-sulfonyl acetate as an acid moiety, such as bis(2-amino-2-thiazolium)methylenebis(sulfonium acetate), 2-amino-2-thiazolium phenylsulfonyl acetate, etc., described in U.S. Pat. No.

4,060,420, and compounds having 2-carboxycarboxyamide as an acid moiety described in U.S. Pat. No. 4,088,496.

The compound or a mixture of these compounds can be used over a wide range of amounts. That is, the amount of the compound or compounds is 1/100 to 10 times, in particular, 1/20 to 2 times by mole ratio the amount of the total amount of silver in the silver halide and the organic silver salt oxidizing agent.

The image-forming process of this invention can be performed in the presence of a heat solvent. By the term "heat solvent" in this invention is meant a non-hydrolyzable organic material which is in a solid state in the environmental temperature but shows a mixture melting point together with other component or components at the heat treatment temperature employed or a temperature lower than the heat treatment temperature (but about 10° C. higher than the environmental temperature, preferably at a temperature higher than 60° C.). As the heat solvent, a compound which becomes a solvent for the dye-providing material at the heat development and a compound which is a material having a high dielectric constant and accelerates the physical development of a silver salt are useful.

Preferred examples of useful heat solvent include glycols such as polyethylene glycol having a mean molecular weight of 1,500 to 20,000 described in U.S. Pat. No. 3,347,675; polyethylene oxide derivatives such as the oleic acid esters of polyethylene oxide, etc.; beeswax; monostearin; compounds of high dielectric constant having a —$SO_2$— group or —CO— group, such as acetamide, succinamide, ethyl carbamate, urea, methyl sulfonamide, ethylene carbonate, etc.; the polar materials described in U.S. Pat. No. 3,667,959; lactone of 4-hydroxybutanic acid; methylsulfinylmethane; tetrahydrothiophene-1,1-dioxide; and 1,10-decanediol, methyl anisate, biphenyl suberate, etc., disclosed in "Research Disclosure", December 1976, pages 26–28.

The dye-providing material contained in the light-sensitive material is a colored material and hence it is not so necessary to incorporate an irradiation prevention material or dye and antihalation material or dye in the light-sensitive material but for further improving the sharpness of images formed, the filter dyes and light-absorptive materials described in Japanese Patent Publication No. 3692/73 and U.S. Pat. Nos. 3,253,921, 2,527,583, 2,956,879, etc. can be incorporated in the light-sensitive materials of this invention. The foregoing dyes or materials having heat decoloring property are preferred and examples of such dyes are described in U.S. Pat. Nos. 3,760,019, 3,745,009 and 3,615,432.

The light-sensitive materials used in this invention may, if necessary, contain various additives known as additives for heat developable light-sensitive materials or may have other layers than photosensitive silver halide emulsion layers, such as an antistatic layer, an electric conductive layer, a protective layer, an interlayer, an antihalation layer, a peeling layer, etc. Examples of the additives are described in "Research Disclosure", Vol. 170, No. 17029, June 1978, such as plasticizers, sharpness improvement dyes, antihalation dyes, sensitizing dyes, matting agents, surface active agents, optical whitening agents, antifading agents, etc.

The light-sensitive material used in this invention can be prepared by preparing the coating liquids for a heat developable light-sensitive layer or layers, and, if necessary, other layers such as a protective layer, an interlayer, a subbing layer, a backing layer, etc., and coating these coating liquids, in succession, on a support by, for example, a dip coating method, an air knife coating method, a curtain coating method, or the hopper coating method described in U.S. Pat. No. 3,681,294.

Furthermore, if necessary, two or more layers can simultaneously be coated on a support by the method disclosed in U.S. Pat. No. 2,761,791 and U.K. Pat. No. 837,095.

In this invention, various exposure means may be employed. A latent image is obtained by the imagewise exposure to radiations containing visible light. In general, light sources used for ordinary color print, for example, a tungsten lamp, a mercury lamp, a halogen lamp such as iodine lamp, etc., a xenon lamp, a laser light source, as well as a CRT light source, a fluorescent lamp, a luminum diode, etc., can be used in this invention.

As an original for forming an image, in this invention, a line image such as a drafting, etc., as well as a photographic image having a continuous gradation can be used. Also, persons or scenes may be photographed using a camera. Printing from an original may be performed by contact printing, reflection printing, or enlarged printing.

Also, an image photographed by a video camera, etc., or an image information sent from a television station is directly reproduced on CRT or HOT and the image thus reproduced can be printed by focusing the image onto the heat developable photographic material by contact printing or by means of a lens.

Recently, LED (luminous diode) has been greatly developed and has been used as an exposure means or indicating means in various devices. It is difficult to make LED effectively emitting blue light. Thus, in the case of reproducing natural color images using LED as light sources, three kinds of LEDs emitting green light, red light, and infrared light are used and the light-sensitive material having the layers each sensitive to each of these lights and releasing each of yellow, magenta, and cyan dyes may be used.

That is, the light-sensitive material having a green-sensitive portion (layer) containing a yellow dye-providing material, a red-sensitive portion (layer) containing a magenta dye-providing material and an infrared-sensitive portion (layer) containing a cyan dye-providing material may be used. If necessary, other combinations can be used as a matter of course.

Another method of directly printing the original by contact printing or projection printing is the following method. That is, an original image from a light source is received by a light-receptive element such as a photoelectric tube or CCD, stored in a memory such as a computer, after, if necessary, applying image processing to the stored image information, the image information is reproduced on CRT, and the image thus reproduced is printed on the light-sensitive material as an imagewise light source. Furthermore, three kinds of the foregoing LEDs are energized based on the processed image information to emit each light for imagewise exposing the light-sensitive material.

In this invention, the latent image obtained on the light-sensitive material by light exposure can be developed by overall heating the light-sensitive material to a temperature of about 80° C. to about 250° C. for about 0.5 second to about 300 seconds. The heating temperature may be desirably selected in the foregoing temperature range with the increase or decrease of the heating time. In particular, a temperature range of about 110° C.

to about 160° C. is useful. The heating means may be a simple hot plate, a hot iron, a hot roller, an exothermic material utilizing carbon, titanium white, etc., or similar materials. The heating may also be conducted at the same time with the exposure.

For practically forming a color image in this invention, the mobile dye or dyes obtained by the heat development may be transferred on to a dye-fixing layer or material. For the purpose, the heat developable color photographic material is composed of at least one light-sensitive layer (I) containing at least a silver halide, a reducible dye-releasing agent, and a binder formed on a support and a dye-fixing layer (II) capable of receiving the diffusible dye or dyes formed in the layer (I).

The dye-releasing activator may be incorporated in the light-sensitive layer (I) or dye-fixing layer (II). Or, further, a means of applying a dye-releasing activator (for example, rupturable pods containing the dye-releasing activator, a roller impregnated with the dye-releasing activator, or a means for spraying a liquid containing the dye-releasing activator) may be employed.

Foregoing light-sensitive layer (I) and dye-fixing layer (II) may be formed on the same support or may be formed on separate supports respectively. The dye-fixing layer (II) and the light-sensitive layer (I) may be separated from each other. For example, after image exposure, the light-sensitive material having the dye-fixing layer and the light-sensitive layer is developed by uniformly heating and then the dye-fixing layer or the light-sensitive layer can be peeled off.

Furthermore, when the light-sensitive material having light-sensitive layer (I) on a support and a dye-fixing material having dye-fixing layer (II) on a support are separately formed, after image exposing and uniformly heating the light-sensitive material, the dye-fixing material is superposed on the light-sensitive material, whereby the mobile dye or dyes can be transferred to the dye-fixing layer (II).

Also, the light-sensitive material only is imagewise exposed and then after superposing the dye-fixing material on the light-sensitive material, they may be uniformly heated in the superposed state.

Dye-fixing layer (II) may contain, for example, a dye mordant for fixing a mobile dye or dyes. As the mordant, various mordants can be used and polymer mordants are particularly useful. The dye-fixing material may have another layer or layers in addition to the dye-fixing layer (II) and further may contain a base, a base precursor, and/or a heat solvent in addition to the mordant. In particular, when light-sensitive layer (I) and dye-fixing layer (II) are formed on separate supports, respectively, it is useful to incorporate a base or a base precursor in the dye-fixing material having dye-fixing layer (II).

Examples of the polymer mordant used in this invention are, for example, a polymer having a secondary amino group or a tertiary amino group, a polymer having a nitrogen-containing heterocyclic moiety, and a polymer having the quaternary cationic group thereof, the molecular weight of these polymers being 5,000 to 200,000, in particular 10,000 to 50,000.

For example, there are the vinylpyridine polymers and vinylpyridinium cation polymers disclosed in U.S. Pat. Nos. 2,548,564, 2,484,430, 3,148,061, 3,756,814, etc.; the polymer mordants crosslinkable with gelatin, etc. disclosed in U.S. Pat. Nos. 3,625,494, 3,859,096 and 4,128,538, U.K. Pat. No. 1,277,453, etc.; the aqueous sol-type mordants disclosed in U.S. Pat. Nos. 3,958,995, 2,721,852 and 2,798,063, and Japanese Patent Application (OPI) Nos. 114,228/79, 145,529/79 and 126,027/79; the water-insoluble mordants disclosed in U.S. Pat. No. 3,898,088; the reactive mordants capable of making a covalent bond to dyes disclosed in U.S. Pat. No. 4,168,976; and further the mordants disclosed in U.S. Pat. Nos. 3,709,690, 3,788,855, 3,642,482, 3,488,706, 3,557,066, 3,271,147, 3,271,148, 2,675,316 and 2,882,156, Japanese Patent Application (OPI) Nos. 71,312/75, 30,328/78, 155,528/77, 125/78 and 1,024/78.

Among these mordants, the mordants capable of crosslinking with a matrix such as gelatin, etc.; water-insoluble mordants, and aqueous sol-type (or latex dispersion-type) mordants are preferably used in this invention.

Particularly preferred mordants are shown below.

(1) A polymer having a quaternary ammonium group and a group capable of forming a covalent bond to gelatin (e.g., aldehyde group, chloroalkanoyl group, chloroalkyl group, vinylsulfonyl group, pyridiniumpropionyl group, vinylcarbonyl group, alkylsulfonoxy group, etc.), such as, for example, the polymer of the following formula:

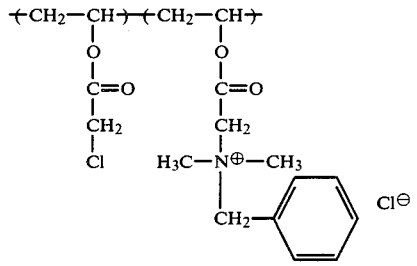

(2) A reaction product of a copolymer composed of the repeating unit of the monomer shown by the following general formula and a repeating unit of other ethylenically unsaturated monomer and a crosslinking agent (e.g., bis-alkane sulfonate, bis-allene sulfonate, etc.):

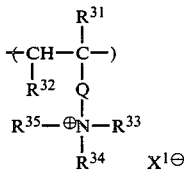

$R^{31}$: H, alkyl group; $R^{32}$: H, alkyl group, aryl group; Q: conventionally known divalent group; $R^{33}$, $R^{34}$, $R^{35}$: alkyl group, aryl group; at least two of $R^{33}$ to $R^{35}$ may combine with each other to form a heterocyclic ring; $X^1$: anion such as halogen ion and sulfonyl ion.

(Foregoing alkyl group and aryl group may be substituted.)

(3) The polymer shown by the following general formula:

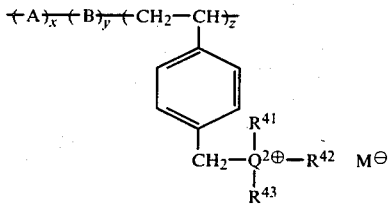

x: about 0.25 to about 5 mole% y: about 0 to about 90 mole% z: about 10 to about 99 mole%

A: repeating unit derived from a monomer having at least two ethylenically unsaturated bonds B: repeating unit derived from a copolymerizable ethylenically unsaturated monomer $Q^2$: N, P $R^{41}$, $R^{42}$ and $R^{43}$: alkyl group, cyclic hydrocarbon group; at least two of $R^{41}$ to $R^{43}$ may combine with each other to form a ring. These groups and rings may be substituted.

M: anion the same as defined for $X^1$ (4) Copolymer composed of (a), (b) and (c):

(a)

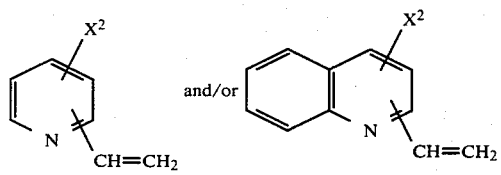

$X^2$: hydrogen atom, alkyl group, or halogen atom (the alkyl group may be substituted).

(b) acrylic acid ester (c) acrylonitrile (5) Water-insoluble polymer having more than $\frac{1}{3}$ of the repeating unit shown by the following general formula:

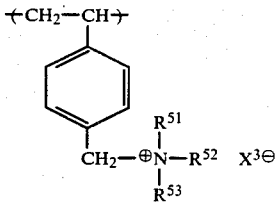

$R^{51}$, $R^{52}$ and $R^{53}$: each represents an alkyl group, the total carbon atom number of $R^{51}$ to $R^{53}$ being larger than 12 (the alkyl group may be substituted).

$X^3$: anion the same as defined for $X^1$.

As gelatin for the mordanting layer, various known gelatins can be used. For example, there are limed gelatin, acid-treated gelatin, etc., or foregoing gelatin chemically denatured by phthalation or sulfonylation. Also, if necessary, gelatin may be subjected to a desalting treatment.

The mixing ratio of the polymer mordant and gelatin and the coating amount of the mordant can be easily determined according to the amount of dye or dyes to be mordanted, the kind and composition of the polymer mordant, and further the image-forming step employed but it is preferred that the mordant polymer/gelatin ratio be 20/80 to 80/20 by weight ratio and the coverage of the mordant polymer be 0.5 to 8 g/m$^2$.

Dye-fixing layer (II) may have a white reflecting layer. For example, a layer of gelatin having dispersed therein titanium dioxide may be formed on the mordanting layer on a transparent support as a white reflecting layer. The titanium dioxide layer forms a white opaque layer and when the transferred color image is viewed from the transparent support side, a reflection-type color image is obtained.

For transferring a dye from the light-sensitive layer to the dye-fixing layer, a dye transferring solvent can be used. As the dye transferring solvent, water or an aqueous basic solution containing sodium hydroxide, potassium hydroxide, an alkali metal salt, etc., can be used. Also, a low boiling point solvent such as methanol, N,N-dimethylformamide, acetone, diisobutyl ketone, etc., or a mixture of the low boiling point solvent and water or an aqueous basic solution can be used. The dye transferring solvent may be used by a method of wetting the dye-fixing layer with the solvent or by a method of incorporating in the material as water or crystallization or microcapsules (melts upon heating) containing the solvent.

The following examples are given to illustrate the present invention in greater detail. However, the scope of the invention is not limited to these examples.

EXAMPLE 1

A mixture of 40 g of gelatin and 26 g of potassium bromide (KBr) was dissolved in 3000 ml of water. The resulting solution was stirred while being maintained at 50° C.

Then, a solution of 34 g of silver nitrate dissolved in 200 ml of water was added to the above-prepared solution over 10 minutes.

Thereafter, a solution of 3.3 g of potassium iodide (KI) dissolved in 100 ml of water was added thereto over 2 minutes.

The thus-prepared silver iodobromide emulsion was precipitated by adjusting its pH to remove an excess of salt.

Then, the pH was adjusted to 6.0, and 400 g of the silver iodobromide emulsion was obtained.

Preparation of Dispersion of Dye-Providing Substance in Gelatin

To 5 g of Reducible Dye-Releasing Agent IA-9 4 g of Electron-Donating Substance ED-22 0.5 g of sodium succinic acid-2-ethyl-hexylestersulfonate, and 10 g of tricresyl phosphate (TCP) was added 20 ml of cyclohexanone, and they were dissolved in cyclohexanone by heating at about 60° C. The solution thus prepared and 100 g of a 10% solution of gelatin were mixed and stirred, and dispersed for 10 minutes by means of a homogenizer at a rate of 10,000 rpm.

This dispersion is called a dispersion of the dye-providing substance.

| Preparation of Light-Sensitive Coating Substance | | |
|---|---|---|
| (a) | Light-sensitive silver iodobromide | 5 g |
| (b) | Dispersion of the dye-providing substance | 3.5 g |
| (c) | Solution of 220 mg of guanidine trichloroacetic acid in 2 ml of ethanol | |
| (d) | 5% Aqueous solution of a compound shown below | 1.5 ml |

-continued

Preparation of Light-Sensitive Coating Substance

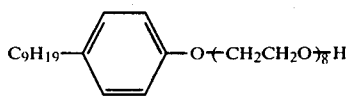

To these ingredients (a) to (d) was added 2 ml of water, and they were dissolved in the water by heating. The resulting solution was coated on a polyethylene terephthalate in a wet coating thickness of 60 μm. The thus-coated material was dried, exposed imagewise for 10 seconds by the use of a 2,000 lux tungsten lamp, and thereafter uniformly heated for 30 seconds on a heat block maintained at 130° C.

Preparation of Dye-Fixing Material with Dye-Fixing Layer

Ten grams of a methyl acrylate/N,N,N-trimethyl-N-vinylbenzylammonium chloride (1:1) copolymer was dissolved in 200 ml of water and uniformly mixed with 100 g of 10% lime-treated gelatin. The resulting mixture was uniformly coated on a polyethylene terephthalate film in a wet coating thickness of 20 μm and then dried. This material was used as a dye-fixing material.

The dye-fixing material impregnated with water was superposed on the above-heated light-sensitive material so that their coating layers came into contact with each other. After 30 seconds, the image-receiving material was peeled apart from the light-sensitive material, whereupon a positive magenta image was formed on the image-receiving material. The density of the positive image was measured by the use of a Macbeth densitometer (TD-504). As a density to green light, $D_{max}$ was 1.75, and $D_{min}$ 0.32. The gradation of the sensitometry curve was such that at a straight line portion, as the exposure amount was increased 10 times, the density increased 1.25 times.

EXAMPLES 2 TO 5

A light-sensitive material, Sample 2, was prepared in the same manner as in Example 1 except that the Dye-Providing Substance IA-9 was replaced by 5 g of Dye-Providing Substance IB-7.

Similarly, light-sensitive materials, Samples 3 to 5, were prepared wherein 5 g of the quinone body of Dye-Providing Substance III-(20), 5 g of Dye-Providing Substance IA-7 and 5 g of the quinone body of Dye-Providing Substance III-(18) were used respectively.

Using the above-prepared materials, Samples 2 to 5, the same procedure as in Example 1 was repeated to form a positive dye image on the image-receiving material. The density of each dye image was measured, and the results are shown in Table 1 below.

TABLE 1

| Sample No. | Dye-Providing Substance | Dye | Maximum Density | Minimum Density |
|---|---|---|---|---|
| 2 | IB-7 | yellow | 1.45 | 0.30 |
| 3 | (Quinone Body of III-(20)) | " | 1.40 | 0.25 |
| 4 | IA-7 | magenta | 1.85 | 0.28 |
| 5 | (Quinone body of III-(18)) | cyan | 1.90 | 0.26 |

EXAMPLE 6

A mixture of 6.5 g of benzotriazole and 10 g of gelatin was dissolved in 1000 ml of water. The resulting mixture was stirred while being maintained at 50° C. A solution of 8.5 g of silver nitrate dissolved in 100 ml of water was added to the above-prepared solution over 2 minutes.

Then, a solution of 1.2 g of potassium bromide in 50 ml of water was added thereto over 2 minutes. The thus-prepared emulsion was precipitated by pH adjustment to remove an excess of salt. Thereafter, the pH of the emulsion was adjusted to 6.0. The yield was 200 g.

A light-sensitive coating material was prepared in the same manner as in Example 1 except that the following ingredients were used.

| | | |
|---|---|---|
| (a) | Benzotriazole silver emulsion containing light-sensitive silver bromide | 10 g |
| (b) | Same dye-providing substance dispersion as used in Example 1 | 3.5 g |
| (c) | Solution of 0.25 g of guanidine trichloroacetic acid in 2 ml of ethanol | |
| (d) | 5% Aqueous solution of a compound shown below | |

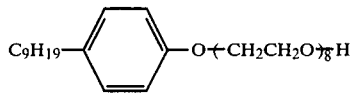

Thereafter, the same procedure as in Example 1 was repeated, whereupon a positive magenta color image was formed on the image-receiving material. The maximum density was 1.95, and the minimum density 0.24.

EXAMPLE 7

The procedure of Example 1 was repeated wherein 0.4 g of 1-phenyl-4-methyl-4-oxymethyl-3-pyrazolidone was added as an electron transfer agent to the light-sensitive coating material of Example 1.

The maximum and minimum densities of the magenta color image thus obtained were 1.80 and 0.29, respectively.

EXAMPLES 8 TO 10

A light-sensitive material, Sample 8, was prepared in the same manner as in Example 1 except that 5 g of the quinone body of Dye-Providing Substance III-(17) was used in place of Dye-Providing Substance IA-9 and 4 g of Electron-Donating Substance ED-1 in place of Electron-Donating Substance ED-22.

Similarly, light-sensitive materials, Samples 9 and 10, were prepared wherein 5 g of the quinone body of Dye-Providing Substance III-(17) and 4 g of Electron-Donating Substance ED-13 and 5 g of the quinone body of Dye-Providing Substance III-(17) and 4 g of Electron-Donating Substance ED-23 were used, respectively.

These light-sensitive materials, Samples 8 to 10, were processed in the same manner as in Example 1 to form a positive color image on the image-receiving material. The results of the density measurement are shown in Table 2 below.

TABLE 2

| Sample No. | Dye-Providing Substance | Electron-Donating Substance | Maximum Density | Minimum Density |
|---|---|---|---|---|
| 8 | Quinone body of III-(17) | ED-1 | 1.52 | 0.30 |
| 9 | Quinone body of III-(17) | ED-13 | 1.69 | 0.33 |
| 10 | Quinone body of III-(17) | ED-23 | 1.84 | 0.26 |

While the invention has been described in detail and with reference to specific embodiments thereof, it will be apparent to one skilled in the art that various changes and modifications can be made therein without departing from the spirit and scope thereof.

What is claimed is:

1. A method of forming an image comprising imagewise exposing and heating a light-sensitive material in a substantially water-free condition, the material comprising a support having provided thereon a light-sensitive silver halide, a binder, a reducing agent capable of reducing the light-sensitive silver halide, an immobile dye-providing substance releasing a mobile dye by intramolecular nucleophilic displacement upon reduction with the reducing agent and an organosilver salt oxidizing agent.

2. A method as claimed in claim 1, wherein the heating is carried out after imagewise exposure.

3. A method as claimed in claim 1, wherein the imagewise exposing and heating are carried out at the same time.

4. A method as claimed in claim 1 wherein the reducing agent is an electron donor or an electron transfer agent, or both of them.

5. A method as claimed in claim 1, wherein the immobile dye-providing substance is one of the compounds represented by the following formulae (IA), and (IB):

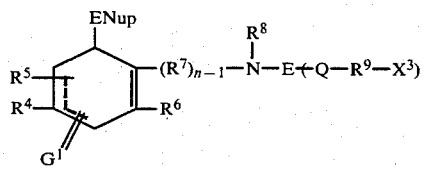

(IA)

wherein:

ENup is an electron-receiving nucleophilic precursor for a hydroxy nucleophilic group;

$G^1$ is an imino group, a sulfonimido group, a cyclic group formed in combination with $R^4$ or $R^6$, or a group specified by ENup;

E is an electrophilic group;

$Q_1$ is a group forming a monoatomic bond between E and $R^9$;

$R^7$ is an alkylene group containing from 1 to 3 carbon atoms in the bonding group, or an alkylene group in which at least one methylene contained in the bonding group is a dialkyl or diarylmethylene bonding group;

n is an integer of 1 or 2;

$R^9$ is an aromatic group containing at least 5 carbon atoms, or an aliphatic hydrocarbon group;

$R^8$ is an alkyl group containing from 1 to 40 carbon atoms or an aryl group containing from 6 to 40 carbon atoms or has the same meaning as that in the substituent $X^1$ as defined above; and $R^6$, $R^4$ and $R^5$ are each a one-atom subsituent, or may each be the substituent $X^1$ assuming that $R^6$ and $R^5$ or $R^4$ and $R^5$ can combine together and form a 5- to 7-membered ring in combination with the remaining portion of the molecule containing a bridged ring,

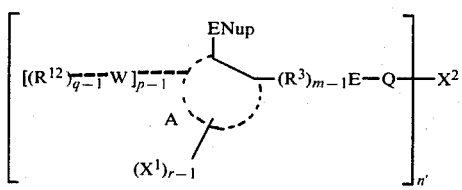

(IB)

wherein:

ENup is the same as defined above;

A is a group containing an atomic group necessary for forming a 5- or 6-membered aromatic ring in combination with the remainder;

W is an electron-withdrawing group having a positive Hammett's $\sigma$ value;

$R^{12}$ is a hydrogen atom, a substituted or unsubstituted alkyl group containing 1 to 30 carbon atoms, or a substituted or unsubstituted aryl group containing 6 to 30 carbon atoms;

$R^3$ is a divalent organic group containing from 1 to 3 carbon atoms in the divalent bonding group;

m and q are each a positive integer of 1 or 2;

p and r are each a positive integer of 1 or more;

$[(R^{12})_{q-1}W]$ is a substituent at an arbitrary point of the aromatic ring structure of A;

E and Q provide an electrophilic cleavage group in which E is an electrophilic center;

n' is an integer of from 1 to 3;

$X^2$ is an image dye-providing substance; and or an image dye precursor as in the case of Q;

$X^1$ is the same as defined above.

6. A method as claimed in claim 5, wherein the image is formed by transferring the mobile dye to a dye-fixing layer.

7. A method as claimed in claim 1, wherein the light-sensitive material is heated in a substantially water-free condition to a temperature of about 80° C. to 250° C. for a sufficient time to effect heat-development.

8. The method as claimed in claim 1, wherein the light-sensitive material further comprises a dye-releasing aid.

9. A method as claimed in claim 8, wherein the dye-releasing aid is incorporated in a dye-fixing material.

10. A method as claimed in claim 6, wherein the mobile dye released is transferred to the dye-fixing layer by the use of water or a basic aqueous solution.

11. A method as claimed in claim 10 wherein a dye mordant is incorporated in the dye-fixing layer.

12. A method as claimed in claim 6, wherein the dye-fixing layer is provided on another support.

13. A method as claimed in claim 6, wherein the dye-fixing layer is provided on the light-sensitive material.

14. A method as claimed in claim 6, wherein the dye portion of the immobile compound is a hydrophilic azo, azomethine, anthraquinone, naphthoquinone, styryl, nitro, quinoline, carbonyl or phthlocyanine dye.

15. A method as claimed in claim 8, wherein the dye-releasing aid is a base or a base-releasing agent.

16. A method as claimed in claim 7, wherein the organosilver salt oxidizing agent is a silver salt of a carboxylic acid derivative or of a nitrogen-containing heterocyclic compound.

17. A method as claimed in claim 16, wherein the organosilver salt oxidizing agent is a silver salt of a nitrogen-containing heterocyclic compound.

18. A method as claimed in claim 1, wherein the binder is gelatin or its derivative.

19. A heat developable color light-sensitive material comprising a support having provided thereon a light-sensitive silver halide, a binder, a reducing agent capable of reducing the light-sensitive silver halide, an immobile dye-providing substance releasing a mobile dye upon reduction with the reducing agent and an organosilver salt oxidizing agent.

20. A method of forming an image comprising imagewise exposing and heating a light-sensitive material in a substantially water-free condition, the material comprising a support having provided thereon a light-sensitive silver halide, a binder, a reducing agent capable of reducing the light-sensitive silver halide, and an immobile dye-providing substance releasing a mobile dye upon reduction with the reducing agent, represented by the following formulae (IIA) and (IIB);

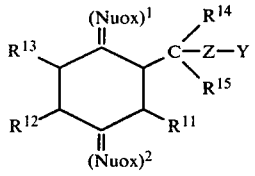

(IIA)

-continued

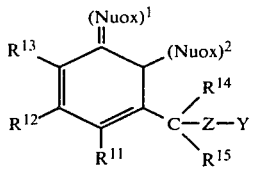

(IIB)

wherein:

$(Nuox)^1$ and $(Nuox)^2$ may be the same or different and each represents an oxidized nucleophilic group;

Z represents a divalent atom group which is electrically negative relative to the carbon atom bearing $R^{14}$ and $R^{15}$;

Y represents a group which becomes a mobile dye after being released along with Z;

$R^{11}$, $R^{12}$ and $R^{13}$ are each hydrogen atom, halogen, an alkyl group, an alkoxyl group or an acylamino group, in which $R^{11}$ and $R^{12}$ may form a condensed ring in combination with the remainder when they are positioned on the ring in an adjacent relation to each other, and $R^{12}$ and $R^{13}$ may form a condensed ring in combination with the remainder;

$R^{14}$ and $R^{15}$ may be the same or different and are each hydrogen, a hydrocarbon group or a substituted hydrocarbon group, provided that at least one of $R^{11}$, $R^{12}$, $R^{13}$, $R^{14}$ and $R^{15}$ contains a large group sufficient for preventing the above-described compound from moving in the layer;

and an organosilver salt oxidizing agent.

21. A method as claimed in claim 7, wherein the light-sensitive material is heated in a substantially water-free condition to a temperature of about 110° C. to 160° C.

* * * * *